US010502099B2

(12) United States Patent
Heinen et al.

(10) Patent No.: US 10,502,099 B2
(45) Date of Patent: Dec. 10, 2019

(54) SYSTEM AND METHOD FOR FREE-PISTON POWER GENERATION BASED ON THERMAL DIFFERENCES

(71) Applicant: Raytheon Company, Waltham, MA (US)

(72) Inventors: Gregory W. Heinen, Lowell, MA (US); Craig H. McCordic, Medfield, MA (US)

(73) Assignee: Raytheon Company, Waltham, MA (US)

( * ) Notice: Subject to any disclaimer, the term of this patent is extended or adjusted under 35 U.S.C. 154(b) by 36 days.

(21) Appl. No.: 15/873,422

(22) Filed: Jan. 17, 2018

(65) Prior Publication Data

US 2018/0209308 A1 Jul. 26, 2018

Related U.S. Application Data

(60) Provisional application No. 62/449,398, filed on Jan. 23, 2017.

(51) Int. Cl.
*F01K 25/10* (2006.01)
*B63G 8/00* (2006.01)
(Continued)

(52) U.S. Cl.
CPC ..... *F01K 25/103* (2013.01); *B63G 8/001* (2013.01); *F01K 13/00* (2013.01); *F01K 13/02* (2013.01);
(Continued)

(58) Field of Classification Search
CPC ... F03G 7/04; F03G 7/05; F01K 25/10; F01K 25/103; F01K 15/04; F01K 27/005;
(Continued)

(56) References Cited

U.S. PATENT DOCUMENTS 1,315,267 A 9/1919 White
1,361,561 A 12/1920 Yancey
(Continued)

FOREIGN PATENT DOCUMENTS

DE 215277 C 12/1906
EP 2660433 A1 11/2013
(Continued)

OTHER PUBLICATIONS

Heinen et al., "Systems and Methods for Power Generation Based on Surface Air-To-Water Thermal Differences", U.S. Appl. No. 15/787,948, filed Oct. 19, 2017, 35 pages.
(Continued)

*Primary Examiner* — Mark A Laurenzi
*Assistant Examiner* — Xiaoting Hu

(57) ABSTRACT

An apparatus includes a generator configured to generate electrical power. The apparatus also includes first and second tanks each configured to receive and store a refrigerant under pressure. The apparatus further includes a first piston assembly having a first piston that divides a volume within the first piston assembly into first and second spaces each configured to receive refrigerant from at least one of the tanks. In addition, the apparatus includes a second piston assembly having a second piston coupled to the first piston. The generator is configured to generate the electrical power based on movement of at least one of the first and second pistons. During use, flows of the refrigerant between the tanks and the spaces can be created based on a pressure differential, such as a pressure differential created by a temperature difference between the tanks.

20 Claims, 11 Drawing Sheets

(51) Int. Cl.

| | |
|---|---|
| ***F01K 15/04*** | (2006.01) |
| ***F01K 27/00*** | (2006.01) |
| ***F01K 13/00*** | (2006.01) |
| ***F01K 13/02*** | (2006.01) |
| ***B63G 8/08*** | (2006.01) |

(52) U.S. Cl.
CPC ..... *F01K 15/04* (2013.01); *F01K 27/005* (2013.01); *B63G 8/08* (2013.01); *B63G 2008/002* (2013.01)

(58) Field of Classification Search
CPC . F01K 1/12; F01K 13/00; F01K 13/02; B63G 8/00; B63G 8/001; B63G 8/08; B63G 2008/002; B63G 2008/004; B63G 2008/005; B63G 2008/007
See application file for complete search history.

(56) References Cited

U.S. PATENT DOCUMENTS

| | | | | |
|---|---|---|---|---|
| 1,421,369 | A | 7/1922 | Ardo | |
| 1,710,670 | A | 4/1929 | Bonney | |
| 2,000,746 | A | 5/1935 | Dray | |
| 2,381,478 | A | 8/1945 | Zukor | |
| 2,537,929 | A | 1/1951 | Daly et al. | |
| 2,642,693 | A | 6/1953 | Broady | |
| 2,720,367 | A | 10/1955 | Doolittle | |
| 2,750,794 | A | 6/1956 | Downs | |
| 2,783,955 | A | 3/1957 | Fitz Patrick | |
| 2,823,636 | A | 2/1958 | Gongwer et al. | |
| 2,826,001 | A | 3/1958 | Presnell | |
| 2,845,221 | A | 7/1958 | Vine et al. | |
| 2,911,792 | A | 11/1959 | Rinia | |
| 2,964,874 | A | 12/1960 | Ruiz | |
| 3,157,145 | A | 11/1964 | Farris et al. | |
| 3,376,588 | A | 4/1968 | Berteaux et al. | |
| 3,698,345 | A | 10/1972 | Kreitner | |
| 3,815,555 | A * | 6/1974 | Tubeuf | F01K 21/04 123/19 |
| 3,818,523 | A | 6/1974 | Stillman, Jr. | |
| 3,901,033 | A | 8/1975 | McAlister | |
| 3,918,263 | A * | 11/1975 | Swingle | F01K 23/14 60/614 |
| 4,403,154 | A | 9/1983 | Reale et al. | |
| 4,445,818 | A | 5/1984 | Ohsaki et al. | |
| 4,577,583 | A | 3/1986 | Green, II | |
| 4,850,551 | A | 7/1989 | Krawetz et al. | |
| 4,919,637 | A | 4/1990 | Fleischmann | |
| 5,134,955 | A | 8/1992 | Manfield | |
| 5,291,847 | A | 3/1994 | Webb | |
| 5,303,552 | A | 4/1994 | Webb | |
| 5,579,640 | A | 12/1996 | Gray, Jr. et al. | |
| 5,615,632 | A | 4/1997 | Nedderman, Jr. | |
| 6,142,092 | A | 11/2000 | Coupland | |
| 6,263,819 | B1 | 7/2001 | Gorustein et al. | |
| 6,328,622 | B1 | 12/2001 | Geery | |
| 6,601,471 | B2 | 8/2003 | Tarnopolsky et al. | |
| 6,651,167 | B1 | 11/2003 | Terao et al. | |
| 6,694,844 | B2 | 2/2004 | Love | |
| 6,734,574 | B2 | 5/2004 | Shin | |
| 7,501,788 | B2 | 3/2009 | De Abreu | |
| 8,046,990 | B2 | 11/2011 | Bollinger et al. | |
| 8,069,808 | B1 | 12/2011 | Imlach et al. | |
| 8,106,527 | B1 | 1/2012 | Carr | |
| 8,117,842 | B2 | 2/2012 | McBride et al. | |
| 8,205,570 | B1 | 6/2012 | Tureaud et al. | |
| 9,834,288 | B1 | 12/2017 | Heinen | |
| 2006/0059912 | A1* | 3/2006 | Romanelli | F01K 25/02 60/645 |
| 2007/0186553 | A1 | 8/2007 | Lin | |
| 2008/0088171 | A1 | 4/2008 | Cheng | |
| 2009/0178603 | A1 | 7/2009 | Imlach et al. | |
| 2009/0277400 | A1 | 11/2009 | Conry | |
| 2010/0192575 | A1 | 8/2010 | Al-Mayahi et al. | |
| 2010/0327605 | A1 | 12/2010 | Andrews | |
| 2011/0051880 | A1 | 3/2011 | Al-Mayahi et al. | |
| 2011/0101579 | A1 | 5/2011 | Polakowski et al. | |
| 2011/0167825 | A1 | 7/2011 | Mauran et al. | |
| 2011/0314811 | A1 | 12/2011 | Jones et al. | |
| 2012/0091942 | A1 | 4/2012 | Jones et al. | |
| 2012/0289103 | A1 | 11/2012 | Hudson et al. | |
| 2013/0068973 | A1 | 3/2013 | van Ruth | |
| 2013/0180243 | A1* | 7/2013 | Hurtado | F03G 7/04 60/641.6 |
| 2017/0283021 | A1 | 10/2017 | Heinen | |
| 2017/0349252 | A1 | 12/2017 | Heinen | |
| 2017/0350558 | A1 | 12/2017 | Heinen et al. | |
| 2018/0119990 | A1 | 5/2018 | Alsadah | |

FOREIGN PATENT DOCUMENTS

| | | | |
|---|---|---|---|
| EP | 2698506 | A1 | 2/2014 |
| GB | 235363 | A | 6/1925 |
| GB | 541775 | A | 12/1941 |
| GB | 658070 | A | 10/1951 |
| GB | 2422877 | A | 8/2006 |
| WO | 2011000062 | A1 | 1/2011 |

OTHER PUBLICATIONS

Heinen et al., "Systems and Methods Supporting Periodic Exchange of Power Supplies in Uderwater Vehicles or Other Devices", U.S. Appl. No. 15/264,399, filed Sep. 13, 2016, 51 pages.
Bowen, "A Passive Capture Latch for Odyssey-Class AUVs," Technical Report WHOI-98-12, Jun. 1998, 91 pages.
Singh et al., "Docking for an Autonomous Ocean Sampling Network," IEEE Journal of Oceanic Engineering, vol. 26, No. 4, Oct. 2001, pp. 498-514.
Bowen et al., "The Nereus Hybrid Underwater Robotic Vehicle for Global Ocean Science Operations to 11,000m Depth," IEEE, 2008, 10 pages.
Hardy et al., "Unmanned Underwater Vehicle (UUV) deployment and retrieval considerations for submarines," Paper on UUV Deployment and Retrieval Options for Submarines, Apr. 2008, 15 pages.
Cowen, "Flying Plug: A Small UUV Designed for Submarine Data Connectivity (U)," Abstract, 1997, 21 pages.
Gish, "Design of an AUV Recharging System," Massachusetts Institute of Technology, 2004, 134 pages.
Vandenberg, "Manning and Maintainability of a Submarine Unmanned Undersea Vehicle (UUV) Program: A Systems Engineering Case Study," Thesis, Naval Postgraduate School, Sep. 2010, 137 pages.
Griffiths, "Technology and Applications of Autonomous Underwater Vehicles," 2003, 18 pages.
Galletti di Cadilhac, "Docking Systems," 2003, pp. 93-108.
Singh et al., "AOSN MURI: Docking for the Autonomous Ocean Sampling Network", Program #: ONR-322 OM/AOSN N00014-95-1-1316, 1998, 6 pages.
Mosca et al., "Low-Frequency Acoustic Source for AUV Long-Range Communication", iXSea, JAMSTEC, Jun. 2011, 9 pages.
Chao, "Diurnal Variability Part I: Global 1-km SST (G1SST) Part II:GHRSST-DV-Argo Obs. System", California Institute of Technology, Feb. 2011, 19 pages.
Jones et al., "Novel Thermal Powered Technology for UUV Persistant Surveillance", California Institute of Technology, Feb. 2006, 11 pages.
Shimura et al., "Long-Range Time Reversal Communication in Deep Water: Experimental Results", J. Acoust. Soc. Am. 132 (1), Jun. 2012, 5 pages.
NASA,"Utilizing Ocean Thermal Energy in a Submarine Robot", NASA's Jet Propulsion Laboratory, NASA Tech Briefs NPO-43304, Dec. 2008, 4 pages.
Huntsberger et al., "Advanced Energy Storage System for Thermal Engines", California Institute of Technology, Jan. 2013, 16 pages.
Huntsberger et al., "Slocum-TREC Thermal Glider", California Institute of Technology, Jan. 2012, 16 pages.
International Search Report and Written Opinion of the International Searching Authority dated May 18, 2017 for PCT Application No. PCT/US2016/062518, 12 pages.

(56) References Cited

OTHER PUBLICATIONS

Heinen, "Systems and Methods for Augmenting Power Generation Based on Thermal Energy Conversion Using Solar or Radiated Thermal Energy", U.S. Appl. No. 15/725,538, filed Oct. 5, 2017, 35 pages.
International Search Report and Written Opinion of the International Searching Authority dated May 29, 2017 for PCT Application No. PCT/US2017/017499, 13 pages.
"Hydraulic Electrical Generating Systems", Eaton Aerospace Group, Form No. TF500-6B, Jun. 2013, 4 pages.
"Hydraulic Motors", Dayton Lamina Corporation, Form 029-3, May 2013, 8 pages.
"HG Hydraulic Generator", Dynaset, downloaded on Sep. 6, 2016, 5 pages.
McGee et al., "Free Piston Hydraulic Pump", Berkeley Robotics & Human Engineering Laboratory, downloaded on Sep. 6, 2016, 4 pages.
Daley, "Hydraulic Generator Drive Robust Control", IFPE 2014, Paper 9.1, Mar. 2014, 4 pages.
"1/14 8x8 Armageddon Hydraulic Dump Truck (Full Metal)", downloaded from http://www.rc4wdforum.com/showthread.php?12884-1-14-8x8-Armageddon-Hydraulic-Dump-Truck on Aug. 22, 2016, 23 pages.
Berkner, "How, Why, and When to apply electric motors to mobile hydraulic systems", Parker Hannifin 2008 Global Mobile Sales Meeting & Symposium, Whitepaper #0001, 2008, 10 pages.
Aintablian et al., "A Hydraulic-Alternator System for Ocean Submersible Vehicles", IECEC 2012, Jul. 2012, 12 pages.
Aintablain et al., "A Hydraulic Motor-Alternator System for Ocean-Submersible Vehicles", 10th International Energy Conversion Engineering Conference, Jul. 2012, 13 pages.
International Search Report and Written Opinion of the International Search Authority for PCT Patent Application No. PCT/US2017/016976 dated Feb. 12, 2018, 18 pages.
Chao, "Autonomous Underwater Vehicles and Sensors Powered by Ocean Thermal Energy", ORE Seminar, Jan. 2016, 1 page.
Chao, "Diurnal Variability, Part I: Global 1-km SST (G1SST), Part II: GHRSST-DV-Argo Obs. Systems", Feb. 2011, 19 pages.
Swean, Jr., "ONR Unmanned Sea Vehicle Technology Development, AUVSI's Unmanned Systems Program Review 2008", Feb. 2008, 34 pages.
Chao, "Thermal Recharging Battery for Underwater Instrumentations", Oct. 2013, 1 page.

* cited by examiner

SYSTEM AND METHOD FOR FREE-PISTON POWER GENERATION BASED ON THERMAL DIFFERENCES

CROSS-REFERENCE TO RELATED APPLICATION AND PRIORITY CLAIM

This application claims priority under 35 U.S.C. § 119(e) to U.S. Provisional Patent Application No. 62/449,398 filed on Jan. 23, 2017. This provisional application is hereby incorporated by reference in its entirety.

TECHNICAL FIELD

This disclosure generally relates to power generation systems, such as power generation systems that operate based on thermal energy conversion. More specifically, this disclosure relates to a system and method for free-piston power generation based on thermal differences.

BACKGROUND

Unmanned underwater vehicles (UUVs) can be used in a number of applications, such as undersea surveying, recovery, or surveillance operations. However, supplying adequate power to UUVs for prolonged operation can be problematic. For example, one prior approach simply tethers a UUV to a central power plant and supplies power to the UUV through the tether. However, this clearly limits the UUV's range and deployment, and it can prevent the UUV from being used in situations requiring independent or autonomous operation. Another prior approach uses expanding wax based on absorbed heat to generate power, but this approach provides power in very small amounts, typically limited to less than about 200 Watts (W) at a 2.2 Watt-hour (WHr) capacity. Yet another prior approach involves using fuel cells in a UUV to generate power, but fuel cells typically require large packages and substantial space.

SUMMARY

This disclosure provides a system and method for free-piston power generation based on thermal differences.

In a first embodiment, an apparatus includes a generator configured to generate electrical power. The apparatus also includes first and second tanks each configured to receive and store a refrigerant under pressure. The apparatus further includes a first piston assembly having a first piston that divides a volume within the first piston assembly into first and second spaces each configured to receive refrigerant from at least one of the tanks. In addition, the apparatus includes a second piston assembly having a second piston coupled to the first piston. The generator is configured to generate the electrical power based on movement of at least one of the first and second pistons.

In a second embodiment, a system includes a vehicle having a body and a power generator. The power generator includes a generator configured to generate electrical power. The power generator also includes first and second tanks each configured to receive and store a refrigerant under pressure. The power generator further includes a first piston assembly having a first piston that divides a volume within the first piston assembly into first and second spaces each configured to receive refrigerant from at least one of the tanks. In addition, the power generator includes a second piston assembly having a second piston coupled to the first piston. The generator is configured to generate the electrical power based on movement of at least one of the first and second pistons.

In a third embodiment, a method includes storing a refrigerant under pressure in first and second tanks. The method also includes moving a first piston in a first piston assembly based on flows of the refrigerant to and from the tanks. The first piston divides a volume within the first piston assembly into first and second spaces each configured to receive the refrigerant from at least one of the tanks. The method further includes moving a second piston of a second piston assembly. The second piston is coupled to the first piston. In addition, the method includes generating electrical power based on movement of at least one of the first and second pistons.

Other technical features may be readily apparent to one skilled in the art from the following figures, descriptions, and claims.

BRIEF DESCRIPTION OF THE DRAWINGS

For a more complete understanding of this disclosure, reference is made to the following description, taken in conjunction with the accompanying drawings, in which.

DETAILED DESCRIPTION

FIGS. 1A through 10, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

It should be noted that, in the following description, it is assumed underwater vehicles supporting free-piston power generation based on thermal differences can dive and perform other functions in a body of water. As described below, the diving allows the underwater vehicles to capture water at different temperatures in order to generate electrical power. However, this need not be the case. Other systems that create thermal differences in other ways can also be used, such as those that heat water using solar energy or energy from thermal vents or those that cool water using radiative or convective cooling. Thus, while the following description describes underwater vehicles that repeatedly ascend and descend in a body of water, the power generation systems described in this patent document are not limited to use with such underwater vehicles.

Figure 1A:
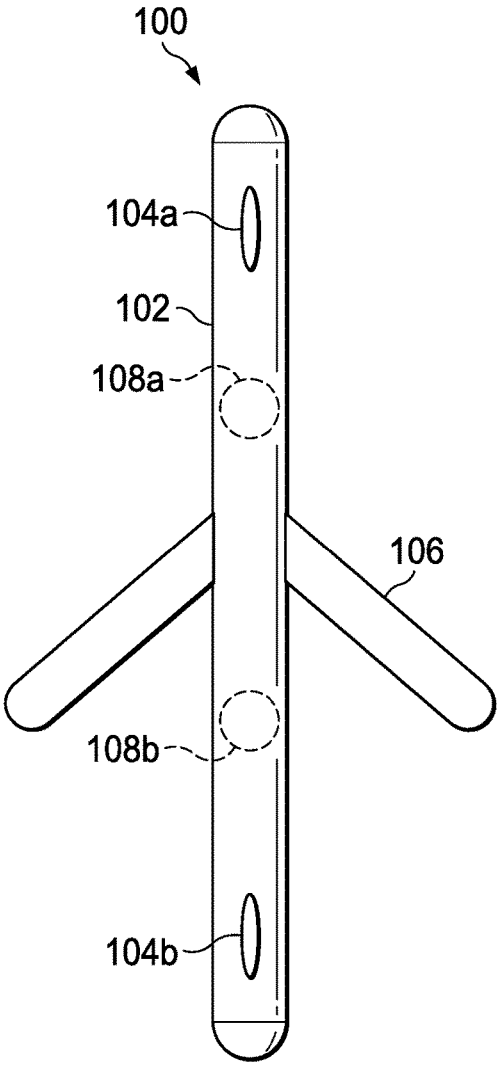
FIGS. 1A through 1D illustrate a first example underwater vehicle that supports free-piston power generation based on thermal differences in accordance with this disclosure.
Figure 1B:
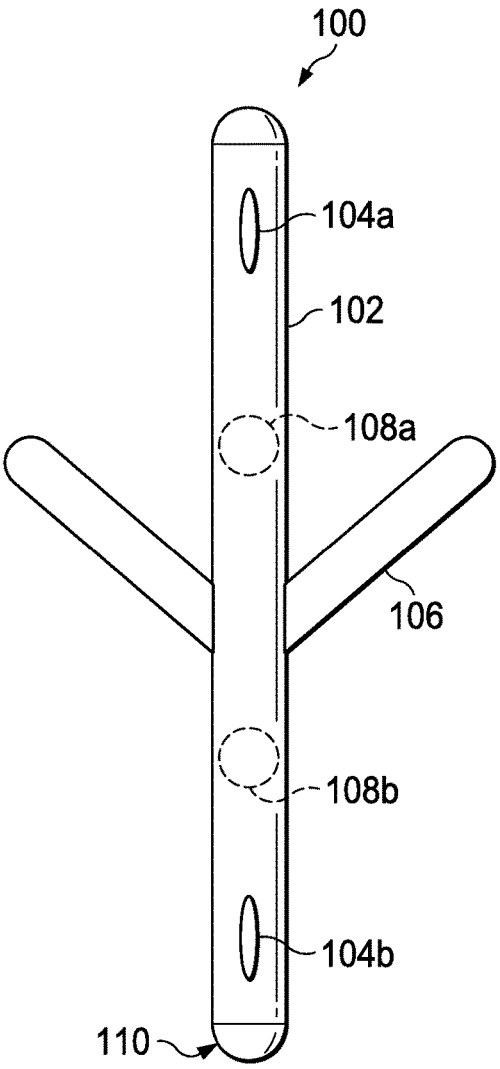
Figure 1C:
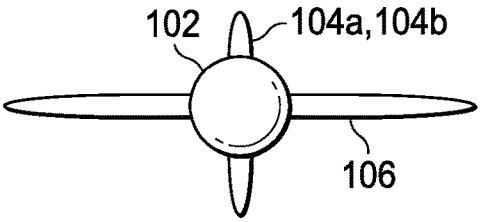
Figure 1D:
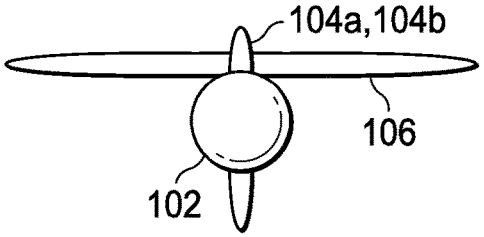

FIGS. 1A through 1D illustrate a first example underwater vehicle 100 that supports free-piston power generation based on thermal differences in accordance with this disclosure. In particular, FIGS. 1A and 1B illustrate the underwater vehicle 100 in different modes of operation, and FIGS. 1C and 1D illustrate alternate positions for certain components of the underwater vehicle 100. In this example, the vehicle 100 represents an unmanned underwater vehicle or other device that can function as both a buoy and a glider within an ocean or other body of water. The vehicle 100 can be used to support various functions, such as undersea surveying, recovery, or surveillance operations.

As shown in FIGS. 1A and 1B, the vehicle 100 includes a body 102 having fins 104*a*-104*b* and wings 106. The body 102 represents any suitable structure configured to encase, protect, or otherwise contain other components of the vehicle 100. The body 102 can be formed from any suitable material(s) and in any suitable manner. As a particular example, the body 102 may include a neutrally-buoyant composite of G10 fiberglass or other material coated with protective ultraviolet paint. In some embodiments, the body 102 can be formed so that the vehicle 100 is able to withstand extremely elevated pressures found at deep depths in an ocean or other body of water. In particular embodiments, the body 102 can allow the vehicle 100 to operate at depths of up to 1,000 meters or more.

The fins 104*a*-104*b* represent projections from the body 102 that help to stabilize the body 102 during travel. Each of the fins 104*a*-104*b* can be formed from any suitable material(s) and in any suitable manner. As a particular example, each of the fins 104*a*-104*b* may include a neutrally-buoyant composite of G10 fiberglass or other material coated with protective ultraviolet paint. Also, each of the fins 104*a*-104*b* can have any suitable size, shape, and dimensions. Further, at least some of the fins 104*a*-104*b* can be movable or adjustable to help alter the course of the body 102 and to steer the body 102 through water during travel. In addition, the numbers and positions of the fins 104*a*-104*b* shown here are examples only, and any numbers and positions of fins can be used to support desired operations of the vehicle 100.

In some embodiments, the underwater vehicle 100 can both ascend and descend within a body of water during use. In these embodiments, the fins 104*a* can be used to steer the vehicle 100 while ascending, and the fins 104*b* can be used to steer the vehicle 100 while descending. Moreover, when the vehicle 100 is ascending, the fins 104*a* can be used to control the pitch of the vehicle 100, and a differential between the fins 104*a* can be used to control the roll of the vehicle 100. Similarly, when the vehicle 100 is descending, the fins 104*b* can be used to control the pitch of the vehicle 100, and a differential between the fins 104*b* can be used to control the roll of the vehicle 100.

The wings 106 support gliding movement of the vehicle 100 underwater. For example, in some instances, the vehicle 100 can be placed into a body of water and programmed to travel short or long distances to reach desired destinations. When traveling, the vehicle 100 can be positioned generally horizontal, and the wings 106 help to enable the vehicle 100 to travel short or long distances using reduced or minimal amounts of energy. Once in a desired location, the wings 106 can be stowed or used when the vehicle 100 ascends or descends. The wings 106 are also moveable to support different directions of travel. For example, the wings 106 are swept downward in FIG. 1A when the vehicle 100 is ascending, and the wings 106 are swept upward in FIG. 1B when the vehicle 100 is descending. In this way, the wings 106 help to facilitate easier or more rapid movement of the vehicle 100 while ascending or descending.

Each of the wings 106 can be formed from any suitable material(s) and in any suitable manner. As a particular example, each of the wings 106 may include a neutrally-buoyant composite of G10 fiberglass or other material coated with protective ultraviolet paint. Also, each of the wings 106 can have any suitable size, shape, and dimensions. In addition, the number and positions of the wings 106 shown here are examples only, and any number and positions of wings can be used to support desired operations of the vehicle 100.

The underwater vehicle 100 may further include one or more ballasts 108*a*-108*b*, which help to control the center of gravity of the vehicle 100. As described in more detail below, material (such as carbon dioxide or other refrigerant in tanks) can move within a power supply or other portion of the vehicle 100, and that movement can alter the center of gravity of the vehicle 100. Underwater gliders can be particularly susceptible to changes in their centers of gravity, so the vehicle 100 can adjust one or more of the ballasts 108*a*-108*b* as needed or desired (such as during ascent, descent, or horizontal travel) to maintain the center of gravity of the vehicle 100 substantially at a desired location. The adjustment can be made along the long axis of the vehicle 100 so as to balance the pitch of the vehicle 100 during ascent, descent, or horizontal travel.

Each ballast 108*a*-108*b* includes any suitable structure configured to modify the center of gravity of an underwater vehicle. As an example, each ballast 108*a*-108*b* can include a mass that is moved using a lead screw and a motor or other mechanism. As a particular example, a ballast capable of operation at depths of 1,000 meters or more while acting as a pitch trim and moving a 100 gram mass can be used. Other implementations of each ballast 108*a*-108*b* can include use of a displacement piston pump or conventional approaches for pumping water into and out of a ballast tank. Note that the number and positions of the ballasts 108*a*-108*b* shown here are examples only, and any number and positions of ballasts can be used in the vehicle 100.

FIGS. 1C and 1D illustrate different alternate end views of the underwater vehicle 100. In FIG. 1C, the wings 106 are positioned and extend from the body 102 along a line through a center of the body 102. In FIG. 1D, the wings 106 are positioned and extend from the body 102 along a line tangential to the body 102. Either of these positions can be used for the wings 106 in FIGS. 1A and 1B. In either case, the wings 106 can be stowed in a folded position where the wings 106 extend along the length of the body 102 and later unfolded before, during, or after deployment. Stowing the wings 106 along the length of the body 102 allows the vehicle 100 to convert to a buoy-type mode of operation, such as after transit to desired locations (where, during transit, the wings 106 can be deployed as shown in FIGS. 1A and 1B). The fins 104*a*-104*b* can also be utilized in periodic ascents and descents to maneuver the vehicle 100 in order to maintain geographic position.

Figure 2A:
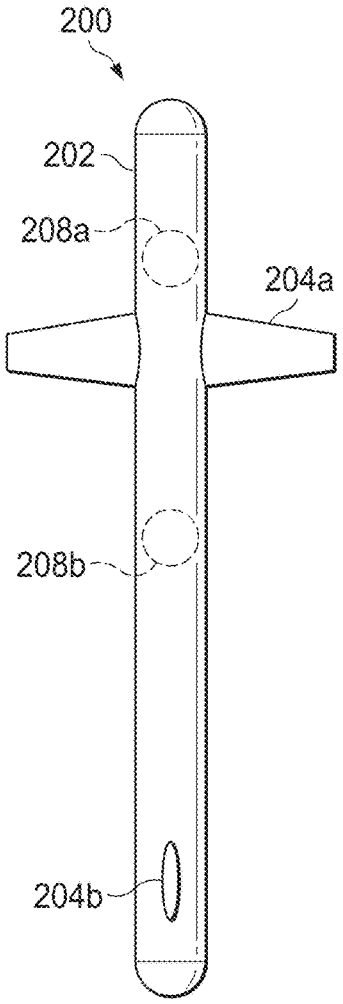
FIGS. 2A through 2C illustrate a second example underwater vehicle that supports free-piston power generation based on thermal differences in accordance with this disclosure.
Figure 2B:
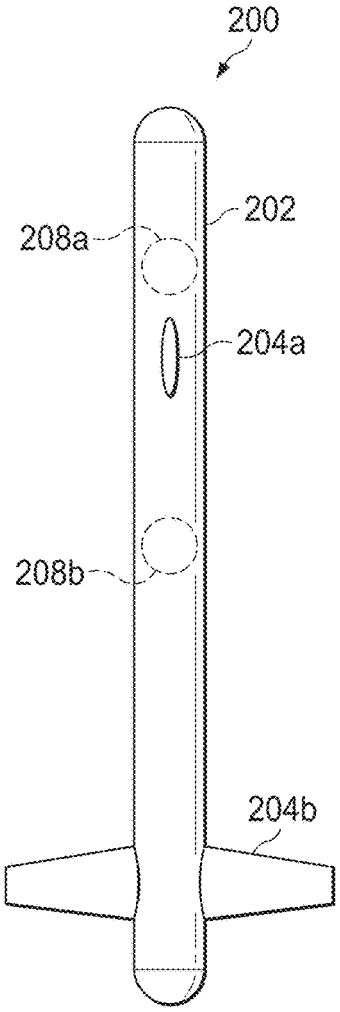
Figure 2C:
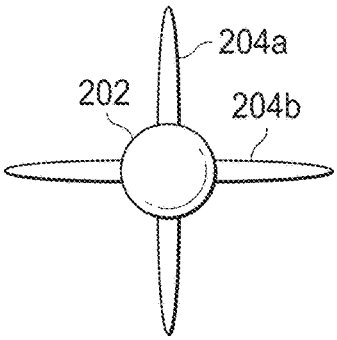

FIGS. 2A through 2C illustrate a second example underwater vehicle 200 that supports free-piston power generation based on thermal differences in accordance with this disclosure. In this example, the vehicle 200 represents an unmanned underwater vehicle or other device that can function as a buoy within an ocean or other body of water. The vehicle 200 can be used to support various functions, such as undersea surveying, recovery, or surveillance operations.

As shown in FIGS. 2A through 2C, the underwater vehicle 200 includes a body 202 and fins 204*a*-204*b*. The body 202 represents any suitable structure configured to encase, protect, or otherwise contain other components of the vehicle 200. The body 202 can be formed from any suitable material(s), such as a neutrally-buoyant composite of G10 fiberglass or other material coated with protective ultraviolet paint, and in any suitable manner. The fins 204*a*-204*b* represent projections from the body 202 that help to stabilize the body 202 during travel. Each of the fins 204*a*-204*b* can be formed from any suitable material(s), such as a neutrally-buoyant composite of G10 fiberglass or other material coated with protective ultraviolet paint, and in any suitable manner. Also, each of the fins 204*a*-204*b* can have any suitable size, shape, and dimensions. Further, at least some of the fins 204*a*-204*b* can be movable or adjustable to help alter the course of the body 202 and to steer the body 102 through water during travel. In addition, the numbers and positions of the fins 204*a*-204*b* shown here are examples only, and any numbers and positions of fins can be used to support desired operations of the vehicle 200. The fins 204*a*-204*b* can be utilized in periodic ascents and descents to maneuver the vehicle 200 in order to maintain geographic position. The vehicle 200 may further include one or more ballasts 208*a*-208*b*, which help to control the center of gravity of the vehicle 200. Each ballast 208*a*-208*b* can, for instance, include a mass that is moved using a lead screw and a motor or other mechanism, a displacement piston pump, or a ballast tank.

As can be seen in FIGS. 2A through 2C, the underwater vehicle 200 lacks wings used to support gliding of the vehicle 200 through water. As a result, the vehicle 200 represents a device that can function as a buoy but generally not as a glider within an ocean or other body of water.

In some embodiments, each underwater vehicle 100 or 200 shown in FIGS. 1A through 2C can remain generally vertical during normal operation. In this configuration, the vehicle 100 or 200 is generally operating as a buoy and can collect information or perform other tasks. Of course, exact vertical orientation is not required during operation of the vehicle 100 or 200. During movement up and down within a body of water, the vehicle 100 or 200 can travel through the water to the surface or to a desired depth of the water. While submerged, the vehicle 100 or 200 can perform operations such as capturing various sensor measurements or searching for anomalies. Periodic surfacing of the vehicle 100 or 200 may allow the vehicle 100 or 200 to (among other things) transmit and receive data, verify its current location, and perform operations needed for power generation (note that the term "periodic" and its derivatives do not require action at a specific interval but merely that an action occurs repeatedly, possibly although not necessarily at a specific interval). After each surfacing, the vehicle 100 or 200 can re-submerge and, if needed, travel at an angle to a desired depth. The angle of travel may be based on the current location of the vehicle 100 or 200 and its desired location, which may allow the vehicle 100 or 200 to operate continuously or near-continuously at a desired station.

As described in more detail below, each of the underwater vehicles 100 and 200 includes a power generation system that operates based on different temperatures or pressures of refrigerant in different tanks. When the tanks have a first temperature differential (or a first temperature-based pressure differential), the refrigerant can be used to move a first piston in one direction. The first piston is attached to a second piston, so movement of the first piston causes the second piston to move. Movement of the second piston causes a hydraulic or other fluid to move through a generator and generate electrical power, which can be used immediately or stored for later use. The temperatures or pressures of the tanks can then be substantially reversed in order to cause the first piston to move in an opposite direction, which again causes the second piston to move and causes the hydraulic or other fluid to move through the generator and generate electrical power. This process can be repeated any number of times to generate power over a prolonged period.

Although FIGS. 1A through 2C illustrate examples of underwater vehicles 100 and 200 that support free-piston power generation based on thermal differences, various changes may be made to FIGS. 1A through 2C. For example, these figures illustrate example underwater vehicles only, and the power generation systems described in this patent document can be used in any other suitable device or system.

Figure 3:
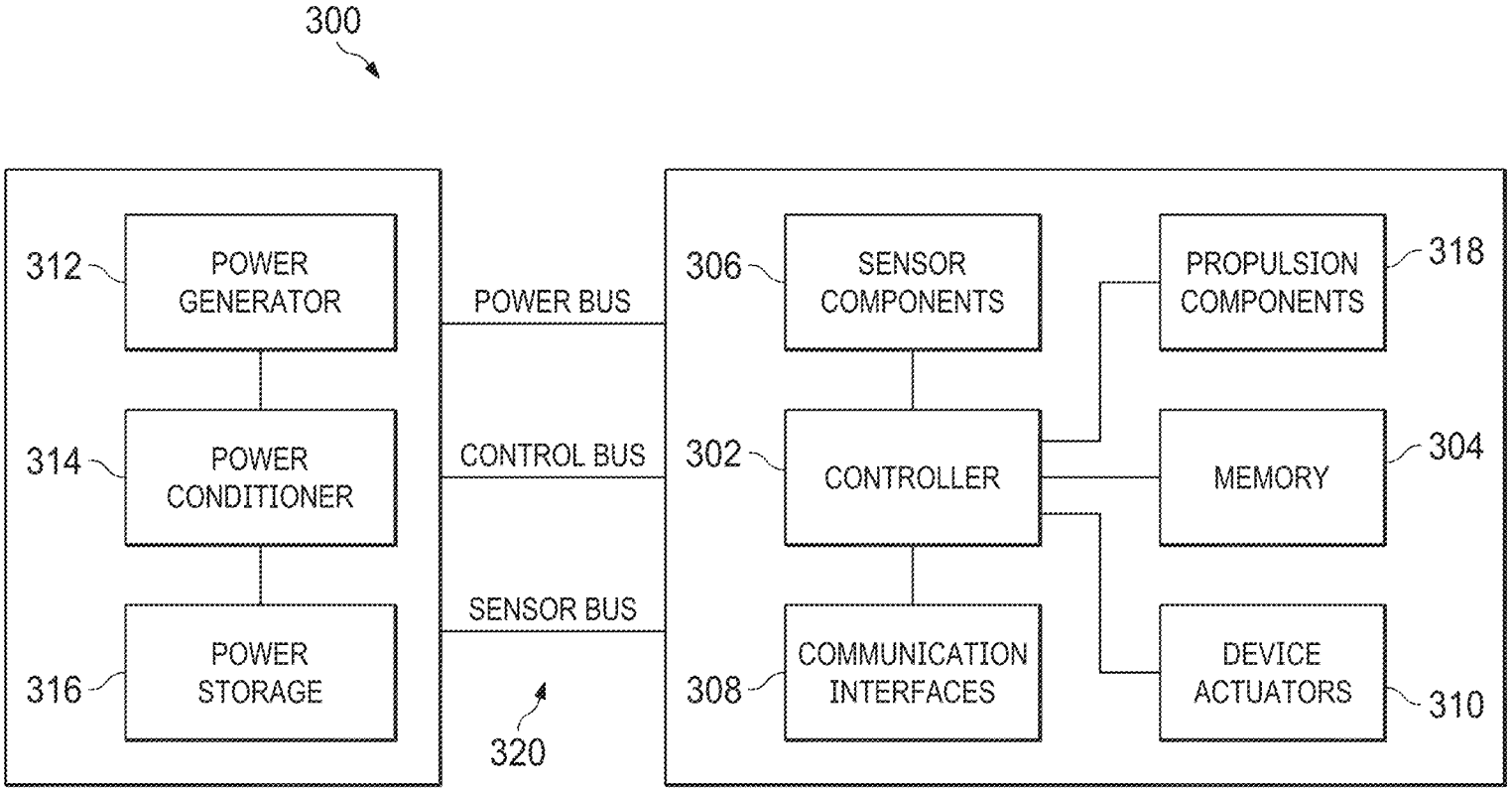
FIG. 3 illustrates example components of an underwater vehicle that supports free-piston power generation based on thermal differences in accordance with this disclosure.

FIG. 3 illustrates example components of an underwater vehicle 300 that supports free-piston power generation based on thermal differences in accordance with this disclosure. The underwater vehicle 300 can, for example, represent either of the underwater vehicles 100 and 200 described above. The components shown in FIG. 3 can therefore represent internal or other components within either of the vehicles 100 and 200 that were not shown in FIGS. 1A through 2C.

As shown in FIG. 3, the vehicle 300 includes at least one controller 302 and at least one memory 304. The controller 302 controls the overall operation of the vehicle 300 and can represent any suitable hardware or combination of hardware and software/firmware for controlling the vehicle 300. For example, the controller 302 can represent at least one processor configured to execute instructions obtained from the memory 304. The controller 302 may include any suitable number(s) and type(s) of processors or other computing or control devices in any suitable arrangement. Example types of controllers 302 include microprocessors, microcontrollers, digital signal processors, field programmable gate arrays, application specific integrated circuits, and discrete circuitry.

The memory 304 stores data used, generated, or collected by the controller 302 or other components of the vehicle 300. Each memory 304 represents any suitable structure(s) configured to store and facilitate retrieval of information (such as data, program code, and/or other suitable information on a temporary or permanent basis). Some examples of the memory 304 can include at least one random access memory, read only memory, Flash memory, or any other suitable volatile or non-volatile storage and retrieval device(s).

The vehicle 300 in this example also includes one or more sensor components 306 and one or more communication interfaces 308. The sensor components 306 include sensors that can be used to sense any suitable characteristics of the vehicle 300 itself or the environment around the vehicle 300. For example, the sensor components 306 can include a position sensor, such as a Global Positioning System (GPS) sensor, which can identify the position of the vehicle 300. This can be used, for instance, to help make sure that the vehicle 300 is following a desired path or is maintaining its position at or near a desired location. The sensor components 306 can also include pressure sensors used to estimate a depth of the underwater vehicle 300. The sensor components 306 can further include audio sensors for capturing audio signals, photodetectors or other cameras for capturing video signals or photographs, or any other or additional components for capturing any other or additional information. Each sensor component 306 includes any suitable structure for sensing one or more characteristics.

The communication interfaces 308 support interactions between the vehicle 300 and other devices or systems. For example, the communication interfaces 308 can include at least one radio frequency (RF) or other transceiver configured to communicate with one or more satellites, airplanes, ships, or other nearby or distant devices. The communication interfaces 308 allow the vehicle 300 to transmit data to one or more external destinations, such as information associated with data collected by the sensor components 306. The communication interfaces 308 also allow the vehicle 300 to receive data from one or more external sources, such as instructions for other or additional operations to be performed by the vehicle 300 or instructions for controlling where the vehicle 300 operates. Each communication interface 308 includes any suitable structure(s) supporting communication with the vehicle 300.

The vehicle 300 may also include one or more device actuators 310, which are used to adjust one or more operational aspects of the vehicle 300. For example, the device actuators 310 can be used to move the fins 104*a*-104*b*, 204*a*-204*b* of the vehicle while the vehicle is ascending or descending. The device actuators 310 can also be used to control the positioning of the wings 106 to control whether the wings 106 are stowed or swept upward or downward (depending on the direction of travel). Each device actuator 310 includes any suitable structure for physically modifying one or more components of an underwater vehicle. Note, however, that the vehicle 300 need not include device actuators 310, such as when the vehicle 300 lacks fins or wings.

The vehicle 300 further includes a power generator 312, a power conditioner 314, and a power storage 316. The power generator 312 generally operates to create electrical energy. In particular, the power generator 312 can operate based on thermal differences between tanks of refrigerant and can be implemented as described below. The power generator 312 includes any suitable structure configured to generate electrical energy based on thermal differences.

The power conditioner 314 is configured to condition or convert the power generated by the power generator 312 into a suitable form for storage or use. For example, the power conditioner 314 can receive a direct current (DC) signal from the power generator 312, filter the DC signal, and store power in the power storage 316 based on the DC signal. The power conditioner 314 can also receive power from the power storage 316 and convert the power into suitable voltage(s) and current(s) for other components of the vehicle 300. The power conditioner 314 includes any suitable structure(s) for conditioning or converting electrical power.

The power storage 316 is used to store electrical power generated by the power generator 312 for later use. The power storage 316 represents any suitable structure(s) for storing electrical power, such as one or more batteries or super-capacitors.

The vehicle 300 may include one or more propulsion components 318, which represent components used to physically move the vehicle 300 through water. The propulsion components 318 can represent one or more motors or other propulsion systems. In some embodiments, the propulsion components 318 can be used only when the vehicle 300 is traveling between a position at or near the surface and a desired depth. During other time periods, the propulsion components 318 can be deactivated. Of course, other embodiments can allow the propulsion components 318 to be used at other times, such as to help maintain the vehicle 300 at a desired location or to help move the propulsion components 318 to avoid observation or detection. Note, however, that the vehicle 300 need not include propulsion components 318.

Various buses 320 can be used to interconnect components of the vehicle 300. For example, a power bus can transport power to various components of the vehicle 300. The power generated by the power generator 312 and the power stored in the power storage 316 can be supplied to any of the components in FIG. 3. For instance, electrical power can be provided to the controller 302 and memory 304 to facilitate computations and instruction execution by the controller 302 and data storage/retrieval by the memory 304. Electrical power can also be provided to the sensor components 306, communication interfaces 308, and device actuators 310 in order to support sensing, communication, and actuation operations. In addition, electrical power can be provided to the propulsion components 318 in order to support movement of the vehicle 300. The power bus may have a range of voltages and purposes, such as 5V, 12V, and 24V main drive power for servos and other device actuators (such as ballasting). A control bus can transport control signals for various components, such as control signals generated by the controller 302. A sensor bus can transport sensor data for various components.

Although FIG. 3 illustrates one example of components of an underwater vehicle 300 that supports free-piston power generation based on thermal differences, various changes may be made to FIG. 3. For example, various components in FIG. 3 can be combined, further subdivided, rearranged, or omitted or additional components can be added according to particular needs.

Figure 4A:
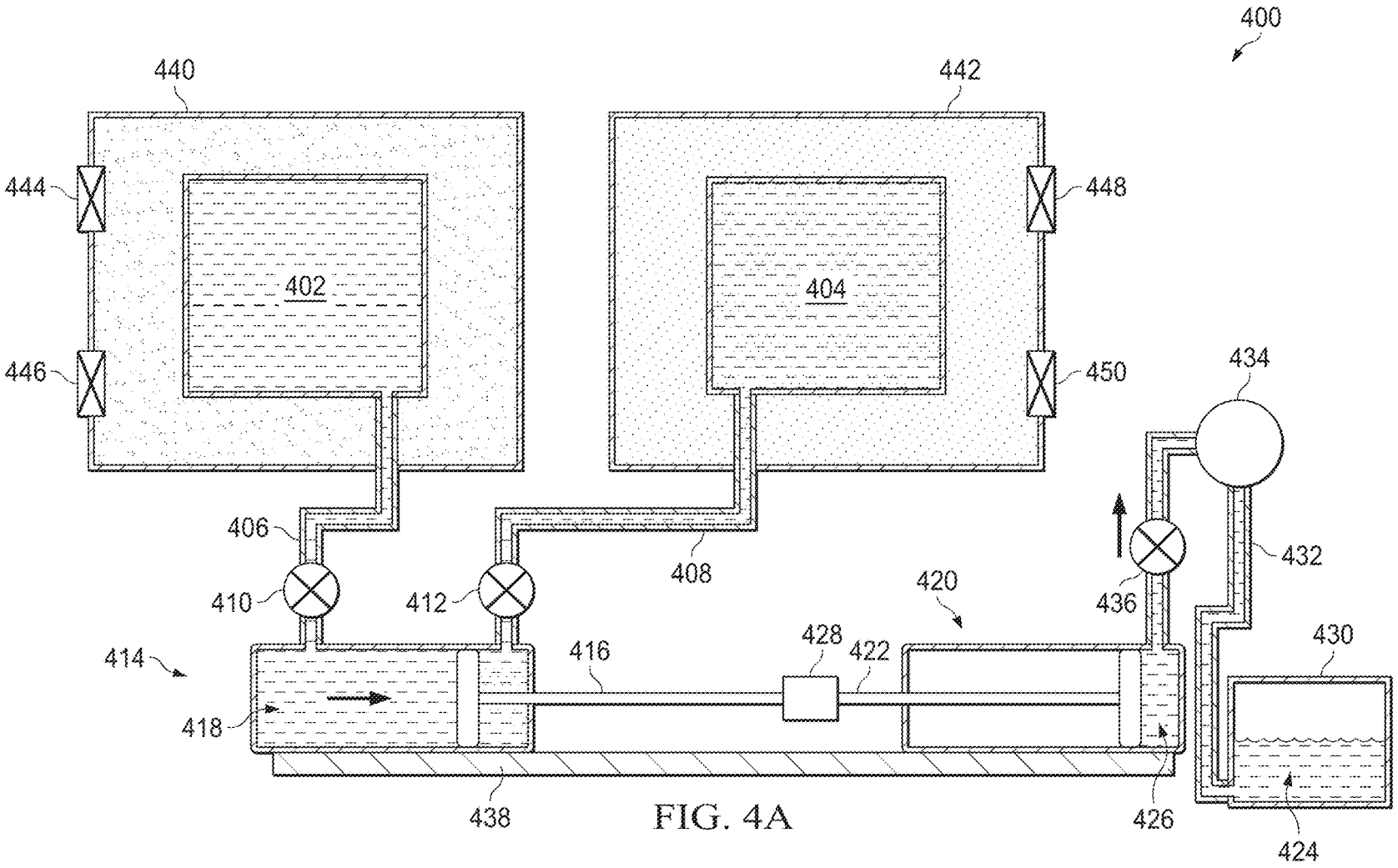
FIGS. 4A and 4B illustrate a first example power generation system that supports free-piston power generation based on thermal differences in accordance with this disclosure.
Figure 4B:
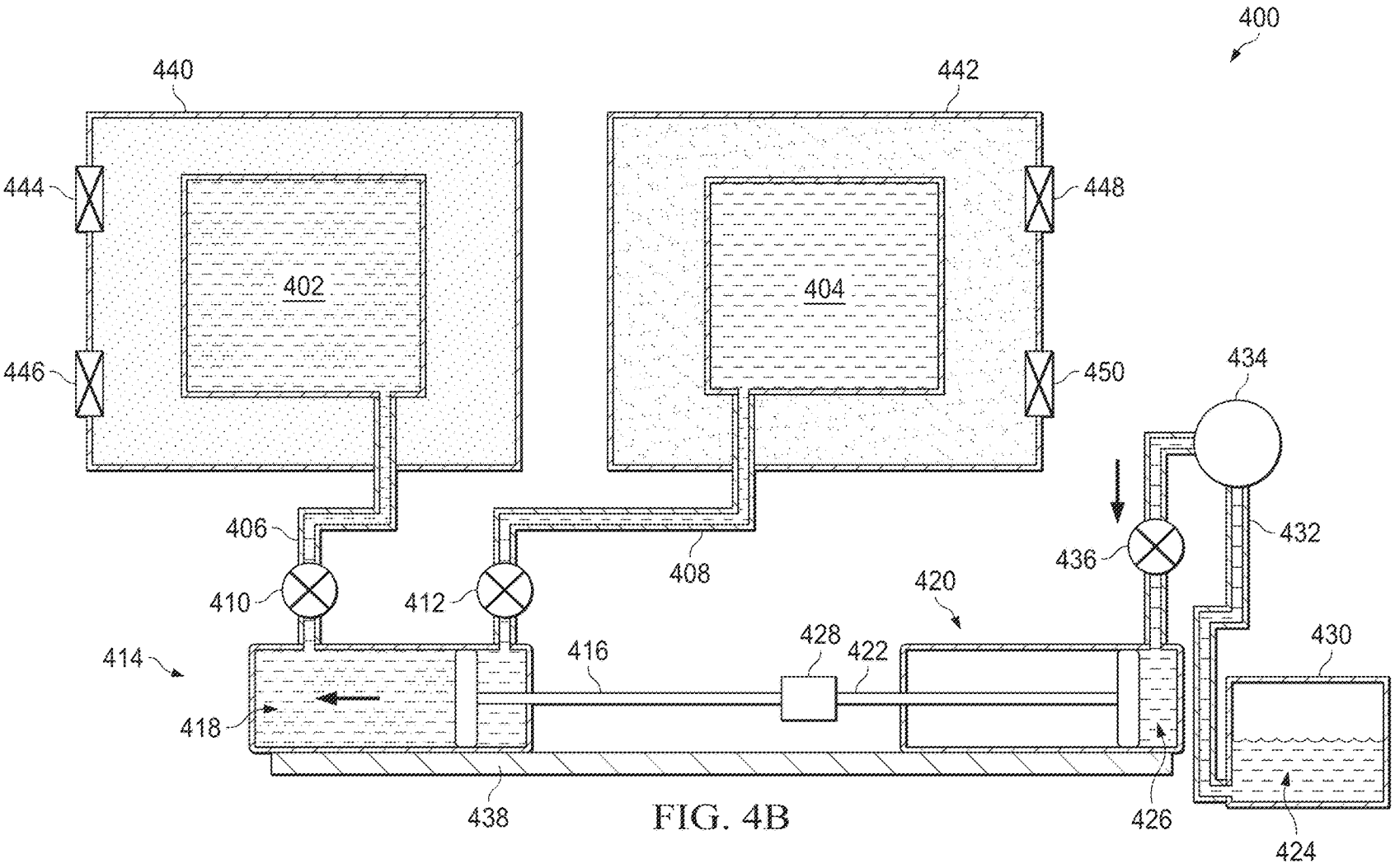

FIGS. 4A and 4B illustrate a first example power generation system 400 that supports free-piston power generation based on thermal differences in accordance with this disclosure. In particular, FIG. 4A illustrates a first half of a power generation cycle, and FIG. 4B illustrates a second half of the power generation cycle. The power generation cycle represented here can repeat any number of times to generate power for an underwater vehicle or other device or system.

The power generation system 400 generally employs a modified Otto cycle. As shown in FIG. 4A, the power generation system 400 includes two tanks 402 and 404, each of which holds a refrigerant under pressure. Passages 406 and 408 are respectively coupled to the tanks 402 and 404 and transport refrigerant to and from the tanks 402 and 404. Valves 410 and 412 control the flow of refrigerant through the passages 406 and 408 and into and out of a first piston assembly 414. The first piston assembly 414 includes a first piston 416 that divides a volume 418 within the first piston assembly 414 into two spaces, one for refrigerant from the tank 402 and one for refrigerant from the tank 404. A head of the piston 416 can be sealed against one or more walls of the piston assembly 414 to prevent leakage of refrigerant from one space of the volume 418 into the other space of the volume 418.

A second piston assembly 420 includes a second piston 422 that is used to pull a hydraulic fluid 424 into a volume 426 within the second piston assembly 420 and to push the hydraulic fluid 424 out of the volume 426. The second piston assembly 420 therefore represents a hydraulic cylinder used to create bidirectional movement of the hydraulic fluid 424, and the piston 422 is said to represent a free piston. A head of the piston 422 can be sealed against one or more walls of the piston assembly 420 to prevent leakage of fluid from one space of the volume 426 into the other space of the volume 426. A connector 428 couples the first piston 416 and the second piston 422 so that movement of the first piston 416 translates into a corresponding movement of the second piston 422.

The hydraulic fluid 424 can be stored in a reservoir 430. The hydraulic fluid 424 can be drawn from the reservoir 430 by the second piston 422, which causes the hydraulic fluid 424 to flow through a passage 432 and through a generator 434. This causes the generator 434 to generate electrical power. Similarly, the hydraulic fluid 424 can be pushed back into the reservoir 430 by the second piston 422, which causes the hydraulic fluid 424 to flow through the passage 432 and through the generator 434 in the opposite direction. Again, this can cause the generator 434 to generate electrical power. A throttle valve 436 can be used to control the flow of the hydraulic fluid 424.

A support 438 couples the piston assemblies 414 and 420, which can be secured to the support 438 in any suitable manner. For example, housings of the piston assemblies 414 and 420 can be bolted onto the support 438 or secured to the support 438 in any other manner. The support 438 helps to maintain the piston assemblies 414 and 420 in a fixed positional relationship with one another so that the first piston assembly 414 can be used to drive the piston 422 in the second piston assembly 414. The support 438 may sometimes be referred to as a "strongback."

As noted above, a temperature differential or a temperature-induced pressure differential can be used to cause movement of the refrigerant to and from the tanks 402 and 404. In this example, the power generation system 400 creates this differential using multiple insulated water jackets 440 and 442. Each insulated water jacket 440 and 442 receives and retains warmer or colder water in order to heat or cool the tank 402 or 404 (and its refrigerant) within that water jacket. In some embodiments, the warmer water can be captured when the power generation system 400 is at or near the surface of a body of water, while the colder water can be captured when the power generation system 400 has submerged to a desired depth (possibly a low depth, like more than 1000 meters). However, other techniques can also be used, such as when the warmer water is created by heating captured water using solar energy or by capturing warmer water near thermal vents or when the cooler water is created by radiative or convective cooling of captured water.

In FIG. 4A, the tank 402 originally contained more refrigerant and is surrounded by warmer water, increasing the pressure in that tank 402. Conversely, the tank 404 originally contained less refrigerant and is surrounded by colder water, lowering the pressure in that tank 404. The pressure difference causes refrigerant from the warmer tank 402 to enter into the piston assembly 414 (namely into the left portion of the volume 418 in FIG. 4A), while refrigerant in the piston assembly 414 (namely from the right portion of the volume 418 in FIG. 4A) enters into the colder tank 404 due to the lower pressure in that tank 404. This moves the piston 416 and therefore the piston 422 in one direction (left to right in FIG. 4A), which can occur during a first half of a power generation cycle.

In FIG. 4B, the process is reversed, with warmer water being used to heat the tank 404, and colder water being used to cool the tank 402. This increases the pressure in the tank 404, causing the refrigerant from the warmer tank 404 to enter into the piston assembly 414 (namely into the right portion of the volume 418 in FIG. 4B). Refrigerant in the piston assembly 414 (namely from the left portion of the volume 418 in FIG. 4B) enters into the colder tank 402 due to the lower pressure in that tank 402. This moves the piston 416 and therefore the piston 422 in the opposite direction (right to left in FIG. 4B), which can occur during a second half of the power generation cycle.

Valves 444-450 are included in the insulated water jackets 440 and 442 to control the flow of warmer or colder water (or water to be heated or cooled) into and out of the insulated water jackets 440 and 442. Although not shown, pumps or other mechanisms can be used to help pull water into or push water out of the insulated water jackets 440 and 442.

Each tank 402 and 404 includes any suitable structure configured to hold a refrigerant under pressure. The refrigerant includes any suitable fluid used to cause movement of a piston, such as liquid carbon dioxide. In some embodiments, each tank 402 and 404 can store about five pounds of liquid carbon dioxide. Each passage 406, 408, 432 includes any suitable pathway for fluid to flow, such as a pipe or tube. In some embodiments, any passages carrying the hydraulic fluid 424 can be made as short as possible to minimize fluid friction losses. Each valve 410, 412, 436, 444-450 includes any suitable structure for selectively controlling the flow of fluid. Each piston assembly 414 and 420 includes any suitable structure having a movable piston. The connector 428 includes any suitable structure for coupling multiple pistons. The hydraulic fluid 424 includes any suitable fluid that can be moved by a piston to create a fluid flow through an electrical generator. The reservoir 430 includes any suitable structure for holding a hydraulic fluid, such as a container or tank. Although not shown, the reservoir 430 can include a vent that prevents over-pressurization of the reservoir 430. The generator 434 includes any suitable structure for generating electrical energy, such as a gear pump having a geared generator or a rotary vane turbine. The support 438 includes any suitable structure that supports multiple piston assemblies, such as a sheet or plate of metal or other material(s). Each insulated water jacket 440 and 442 includes any suitable insulated structure configured to receive and retain water.

Figure 5:
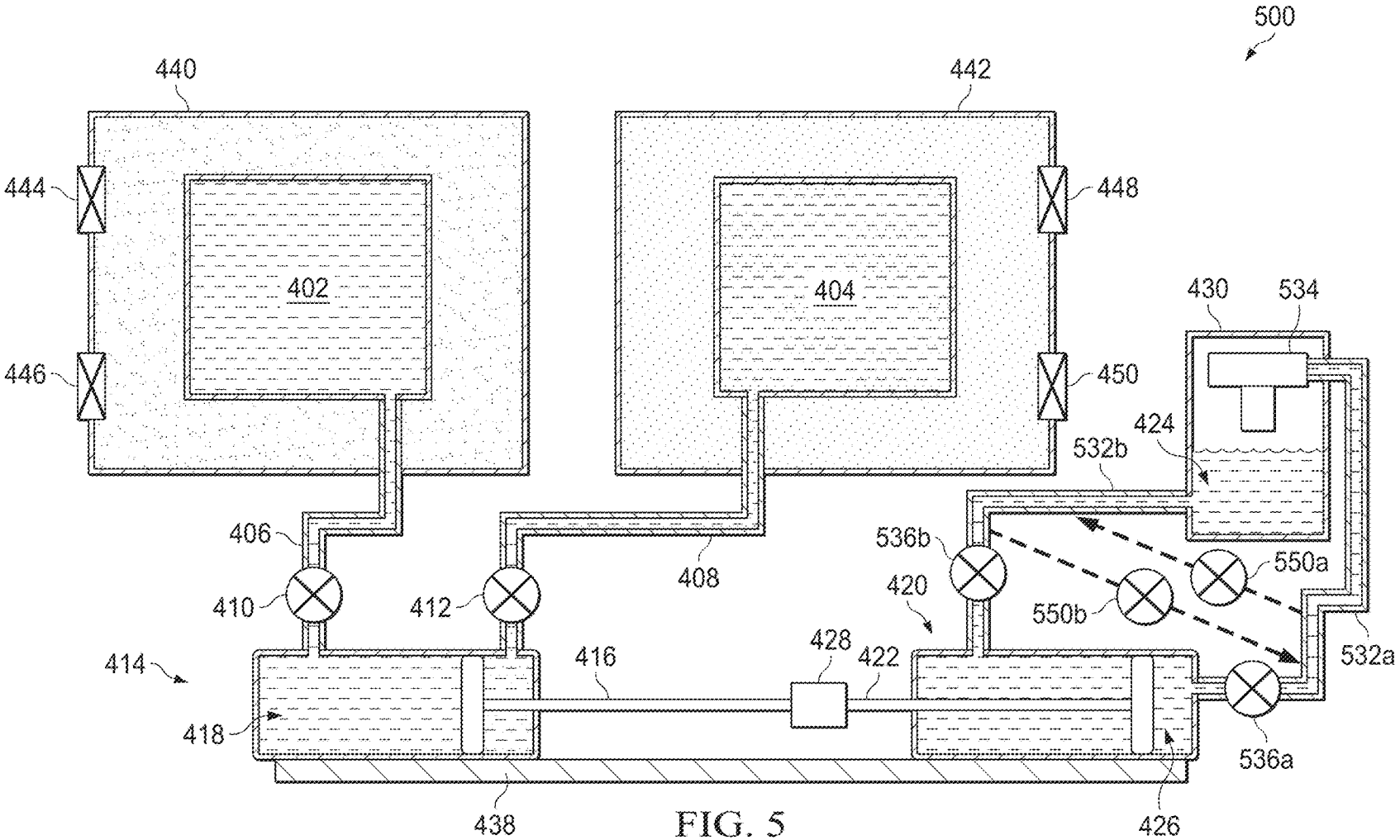
FIG. 5 illustrates a second example power generation system that supports free-piston power generation based on thermal differences in accordance with this disclosure.

Various modifications to the design of the power generation system 400 shown in FIGS. 4A and 4B can be made while still achieving the same general type of operations shown in FIGS. 4A and 4B. For example, FIG. 5 illustrates a second example power generation system 500 that supports free-piston power generation based on thermal differences in accordance with this disclosure. The power generation system 500 shown in FIG. 5 contains many of the same components as the power generation system 400, and these common components are identified using the same reference numerals.

While the generator 434 in the power generation system 400 is external to the reservoir 430, the power generation system 500 includes a generator 534 that resides within the reservoir 430. Also, passages 532*a*-532*b* connect the reservoir 430 to two spaces created within the volume 426 of the second piston assembly 420 by the piston 422. The two spaces within the volume 426 are separated by the head of the piston 422. The generator 534 generates electrical energy based on movement of the hydraulic fluid 424 into the reservoir 430 through the passage 532*a*. Hydraulic fluid 424 that is pushed out of the second piston assembly 420 by the piston 422 passes through the passage 532*a* into the reservoir 430, causing the generator 534 to generate electrical energy. Hydraulic fluid 424 that is pulled into the second piston assembly 420 by the piston 422 passes through the passage 532*b*.

Valves 536*a*-536*b* and 550*a*-550*b* control the flow of the hydraulic fluid 424 through the passages 532*a*-532*b*. Here, the valves 550*a*-550*b* represent crossover valves since they allow the hydraulic fluid 424 to cross over between the passages 532*a*-532*b*. The valves 536*a*-536*b* and 550*a*-550*b* are controlled so that (i) the hydraulic fluid 424 being pushed out of the second piston assembly 420 enters the reservoir 430 via the passage 532*a* and (ii) the hydraulic fluid 424 being pulled into the second piston assembly 420 exits the reservoir 430 via the passage 532*b*. Thus, the valves 550*a*-550*b* can be closed to prevent crossover of the hydraulic fluid 424 between the passages 532*a*-532*b* or opened to allow the crossover of the hydraulic fluid 424 between the passages 532*a*-532*b*. This allows the hydraulic fluid 424 to consistently enter the reservoir 430 through the top of the reservoir 430 and exit the reservoir 430 through the bottom of the reservoir 430.

The generator 534 includes any suitable structure for generating electrical energy within a reservoir. For example, the generator 534 can include a Pelton wheel turbine and a nozzle that sprays hydraulic fluid 424 entering the reservoir 430 from the passage 532*a* onto the Pelton wheel turbine. The sprayed hydraulic fluid 424 collects at the bottom of the reservoir 430 and is returned to the second piston assembly 420 through the passage 532*b*. Each passage 532*a*-532*b* includes any suitable pathway for fluid to flow, such as a pipe or tube. Each valve 536*a*-536*b* and 550*a*-550*b* includes any suitable structure for selectively controlling the flow of fluid.

Figure 6:
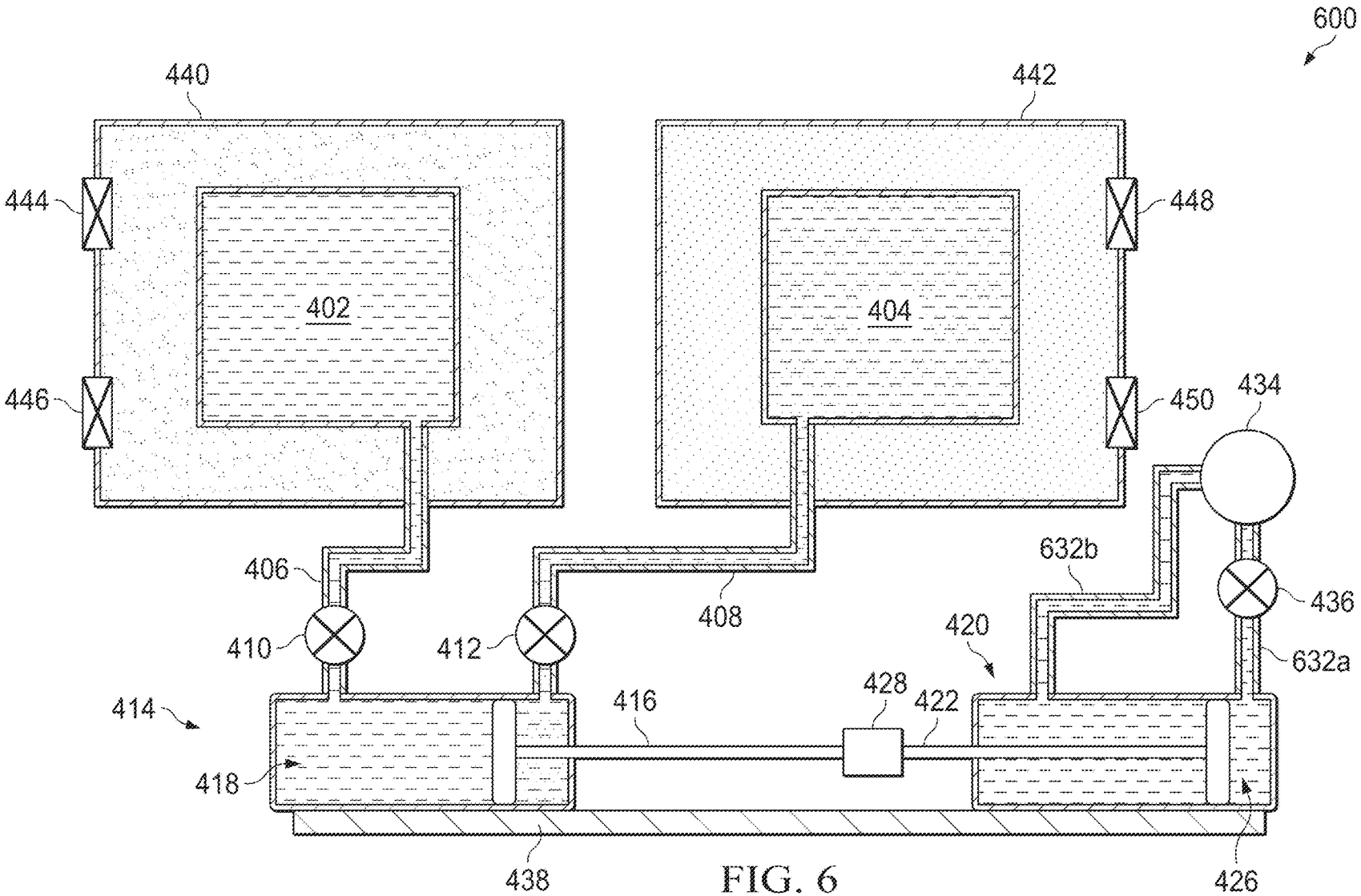
FIG. 6 illustrates a third example power generation system that supports free-piston power generation based on thermal differences in accordance with this disclosure.

FIG. 6 illustrates a third example power generation system 600 that supports free-piston power generation based on thermal differences in accordance with this disclosure. Again, the power generation system 600 shown in FIG. 6 contains many of the same components as the power generation system 400, and these common components are identified using the same reference numerals.

As with the power generation system 400, the generator 434 in the power generation system 600 is an external generator since it is not contained within a fluid reservoir. Unlike the power generation system 400, however, the power generation system 600 does not use the reservoir 430 to hold the hydraulic fluid 424. Rather, passages 632*a*-632*b* couple different spaces of the volume 426 to the generator 434, and the hydraulic fluid 424 is contained entirely within the second piston assembly 420 and the passages 632*a*-632*b*. The hydraulic fluid 424 is therefore used within a loop in FIG. 6, where the hydraulic fluid 424 is pushed out of one portion of the volume 426 and into the other portion of the volume 426. Movement of the piston 422 of the second piston assembly 420 back and forth causes movement of the hydraulic fluid 424 back and forth through the generator 434, which generates electrical energy. The throttle valve 436 can be used to control the flow of the hydraulic fluid 424 through the generator 434. Each passage 632*a*-632*b* includes any suitable pathway for fluid to flow, such as a pipe or tube.

Figure 7:
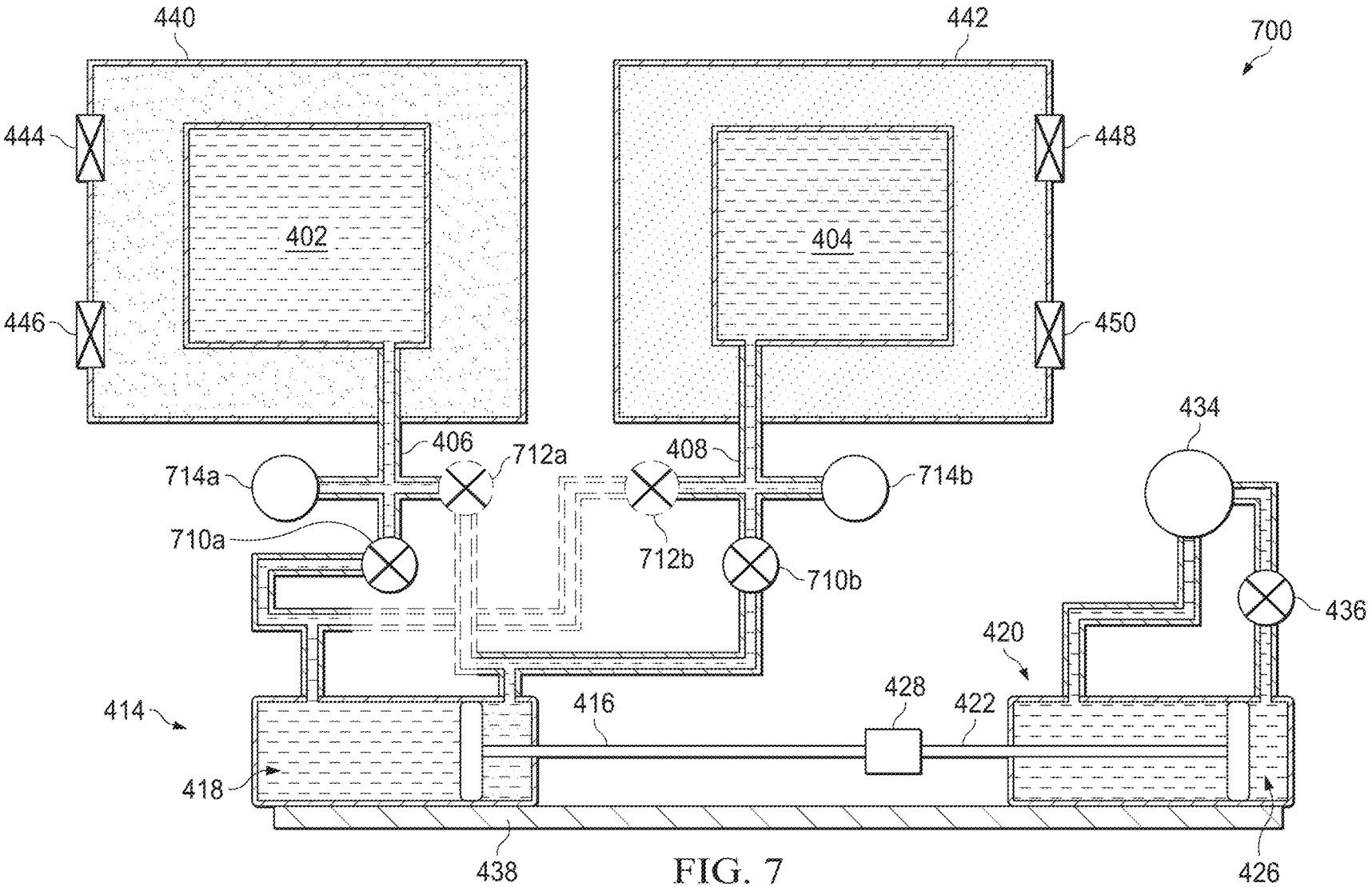
FIG. 7 illustrates a fourth example power generation system that supports free-piston power generation based on thermal differences in accordance with this disclosure.

FIG. 7 illustrates a fourth example power generation system 700 that supports free-piston power generation based on thermal differences in accordance with this disclosure. Once again, the power generation system 700 shown in FIG. 7 contains many of the same components as the power generation system 400, and these common components are identified using the same reference numerals.

The power generation system 700 here allows for crossover of the refrigerant contained in the tanks 402 and 404 into the spaces defined by the piston 416 in the volume 418 of the first piston assembly 414. Thus, refrigerant contained in the tank 402 can enter into the space on the left or right of the piston head in the volume 418, depending on the configuration of the valves 710*a* and 712*a*. Similarly, refrigerant contained in the tank 404 can enter into the space on the left or right of the piston head in the volume 418, depending on the configuration of the valves 710*b* and 712*b*. If needed or desired, refrigerant can be transferred between the tanks 402 and 404 themselves.

The ability to allow the refrigerant contained in the tanks 402 and 404 to cross over into different spaces of the first piston assembly 414 can be useful in various circumstances. For example, in some embodiments, the power generation system 700 can operate so that only one tank 402 or 404 is heated to increase its pressure and only one tank 404 or 402 is cooled to decrease its pressure. The valves 710*a*-710*b* and 712*a*-712*b* can then be configured to provide the appropriate refrigerant flow, depending on which way the piston 416 is to be moved. This may be useful, for instance, if only one tank 402 or 404 can be warmed using solar energy or cooled using radiative or convective cooling.

The power generation system 700 in FIG. 7 also includes two refrigerant service ports 714*a*-714*b*. The service ports 714*a*-714*b* can be used initially to remove air from the tanks 402 and 404, the volume 418 of the first piston assembly 414, and related passages. The service ports 714*a*-714*b* can also be used to pump refrigerant (such as liquid carbon dioxide) into the tanks 402 and 404. The refrigerant can be loaded into the power generation system 700 to achieve a fill factor in the sub-critical, trans-critical, or super-critical region. Each service port 714*a*-714*b* represents any suitable structure configured to allow removal or injection of fluid into a power generation system.

Figure 8A:
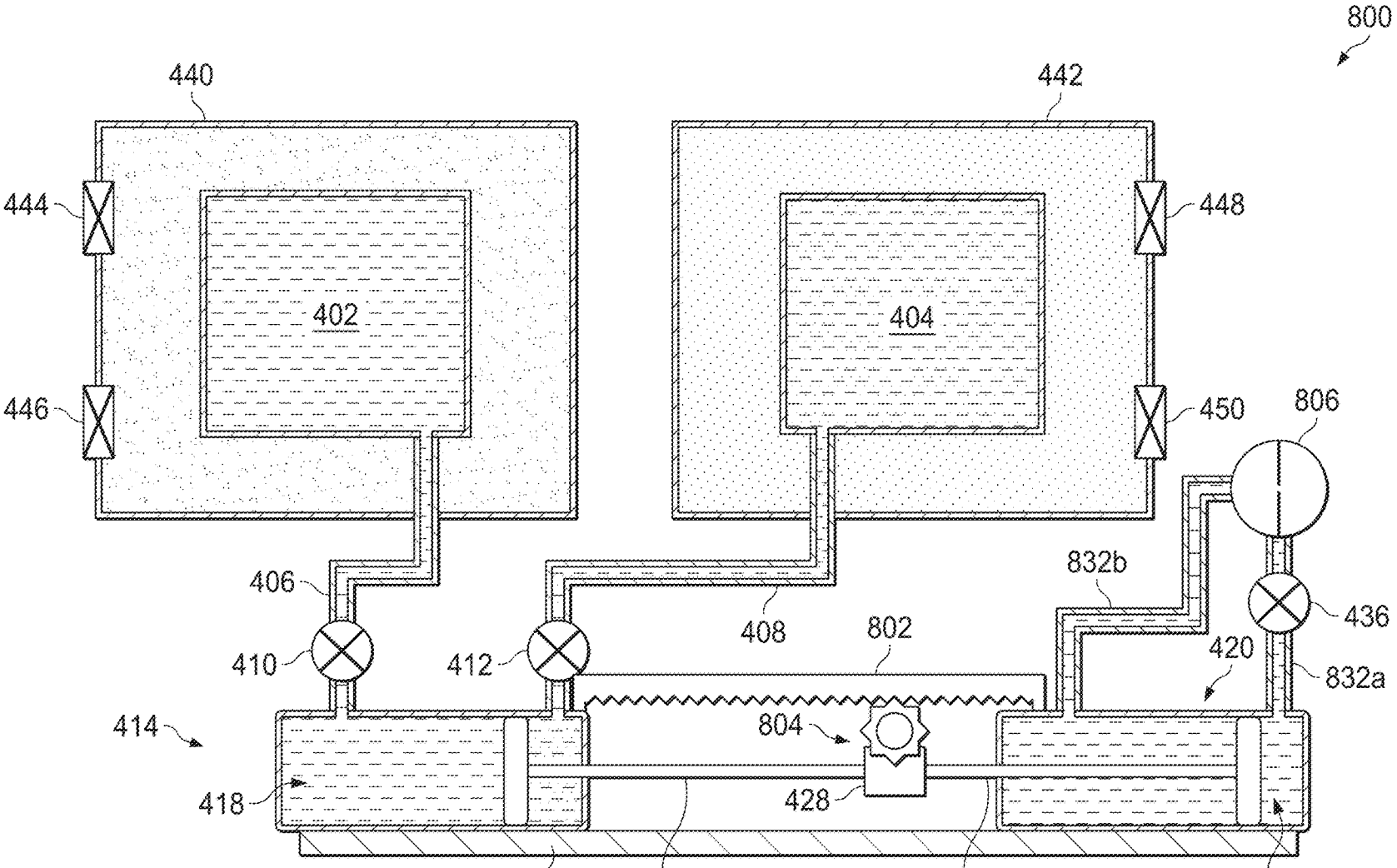
FIGS. 8A and 8B illustrate a fifth example power generation system that supports free-piston power generation based on thermal differences in accordance with this disclosure.
Figure 8B:
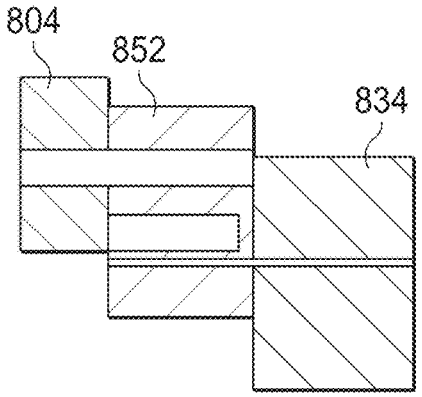

FIGS. 8A and 8B illustrate a fifth example power generation system 800 that supports free-piston power generation based on thermal differences in accordance with this disclosure. Yet again, the power generation system 800 shown in FIG. 8A contains many of the same components as the power generation system 400, and these common components are identified using the same reference numerals.

While prior power generation systems have generated power based on the flow of a hydraulic fluid through a generator, the power generation system 800 operates using a generator that does not receive the hydraulic fluid 424. Rather, the generator has a rack and pinion that includes a linear gear 802 (the rack) and a circular gear 804 (the pinion). The circular gear 804 is attached to or otherwise moves with the connector 428, although the circular gear 804 can be attached to either piston 416 or 422 or other movable component. As the pistons 416 and 422 move back and forth, the circular gear 804 moves against the linear gear 802, which causes the circular gear 804 to rotate. The circular gear 804 also creates rotation in an electrical generator, which generates electrical energy.

In some embodiments, the gear 804 can form part of or operate in conjunction with a multi-stage gearbox. An example of this is shown in FIG. 8B, where the circular gear 804 is attached to a multi-stage speed-increasing gearbox 852. The speed-increasing gearbox 852 is also attached to a generator 834. The speed-increasing gearbox 852 generally operates to translate the rotational speed of the gear 804 into a higher rotational speed for the generator 834. The speed-increasing gearbox 852 can includes at least two stages, where each stage typically includes a gear. The gearbox 852 can have a high gear ratio, such as 100:1 or more. Such a high gear ratio can load very quickly with a high force, so the power generation system 800 can include a mechanism to limit high loading on the gearbox 852. In the example shown in FIG. 8A, this is accomplished using an orifice 806 positioned in one of the passages 832*a*-832*b* through which the hydraulic fluid 424 flows. The orifice 806 slows the movement of the hydraulic fluid 424 through the passages 832*a*-832*b* and reduces the loading placed on the gearbox 852.

The gears 802 and 804 can be formed from any suitable material(s), such as metal, and in any suitable manner. The orifice 806 represents any suitable structure configured to provide a reduced-area passageway for fluid, such as an orifice plate. Each passage 832*a*-832*b* includes any suitable pathway for fluid to flow, such as a pipe or tube. Note that the passages 832*a*-832*b* can be larger in diameter compared to the passages 432, 532*a*-532*b*, 632*a*-632*b* described above to help reduce losses in the passages 832*a*-832*b*. The gearbox 852 includes any suitable gears to translate rotational speed of one gear into a higher rotational speed. The generator 834 includes any suitable structure for generating electrical energy.

Any of the power generation systems 400, 500, 600, 700, 800 can be used to generate any suitable amount of power. The following describes one example implementation of a power generation system, although other implementations can have other or additional characteristics. In some embodiments, the power generation system can operate with a temperature differential of as little as 10° C. between the tanks 402 and 404. This can be adequate to create at least a 300 psi (pounds per square inch) pressure difference between the tanks 402 and 404, such as when the warmer tank is at 950 psi and the colder tank is at 650 psi. The pressure difference can be extended, such as by using a tank at a greater than 100% fill factor in the trans-critical region for larger pressure differences, such as up to 500 psi. Pressures of this magnitude can be effective against a piston with differential action via a dual acting hydraulic cylinder (the piston assembly 420). Assume each tank 402 and 404 is about 300 cubic inches and the hydraulic cylinder has a four-inch diameter and a ten-inch height. When the tanks obtain a pressure difference of 300 psi, a volume exchange of 120 cubic inches or 2 liters of refrigerant can occur. At a transfer rate of 0.4 liters per minute, the power generation system can generate about 120 watts of power for five minutes, providing a 10 Watt-hour capacity.

In these types of power systems, the power systems are able to produce electrical power from a hydraulic motor/generator that is actuated via ocean thermal energy and that is not affected by underwater head pressures. This is because the hydraulic cylinder (the piston assembly 420) can be matched to an identical cylinder (the piston assembly 414), thus cancelling the effect of undersea pressure. The systems can be operated trans-critical with even more pressure differences and more energy yields than sub-critical. The systems can operate effectively at low thermal differences in ocean thermal environments. Moreover, the power generation systems can operate using the insulated water jackets 440 and 442 without the need for additional heat exchangers. Further, the power generation systems do not require the use of a pressure vessel to house a turbine, which would increase the cost and size of the systems. Further, since power is being generated using movement of the hydraulic fluid 424, there are no phases changes of the hydraulic fluid 424 to be engineered or used in the systems. In addition, the power generation systems can be quieter than various conventional power generation systems, and the power generation systems can support power generation over an extremely large number of power generation cycles.

Note that in any of the power generation systems 400, 500, 600, 700, 800, it may be necessary or desirable to provide some assistance in providing starting torque for its generator, such as at the start of each half of a power generation cycle. This assistance can be provided in various ways. In some embodiments, for example, an electronic speed controller (ESC) can be momentarily connected to the generator 434, such as via digital insulated-gate bipolar transistors (IGBTs), and then disconnected from the generator 434 once the generator 434 begins turning. As another example, the startup or run-up forces needed before the generator 834 begins generating electrical energy can be reduced in various ways. For instance, the generator 834 can initially be turned on as a motor, essentially pre-spinning the generator 834 and relieving front end forces where the pinion meets the rack and in the first stages of a gearbox. As another example, the generator 834 might not be loaded until the gearbox 852 is spinning at least at some minimum speed, such as 50% of the gearbox's rated speed.

Although FIGS. 4A through 8B illustrate examples of power generation systems 400, 500, 600, 700, 800 that support free-piston power generation based on thermal differences, various changes may be made to FIGS. 4A through 8B. For example, various components in each figure can be combined, further subdivided, rearranged, or omitted or additional components can be added according to particular needs. Also, shapes, sizes, and dimensions of various components in these figures can vary as needed or desired. As a particular example, the piston assemblies 414 and 420 need not be the same size. In addition, any suitable feature(s) in one or more of these figures can be used in others of these figures. For instance, a reservoir 430 can be used in the power generation systems 700 and 800, or a rack and pinion generator 834 can be used in the power generation systems 400, 500, 600, 700. As another example, the crossover valves 712*a*-712*b* or service ports 714*a*-714*b* in FIG. 7 can be used in the power generation systems 400, 500, 600, 800.

Figure 9:
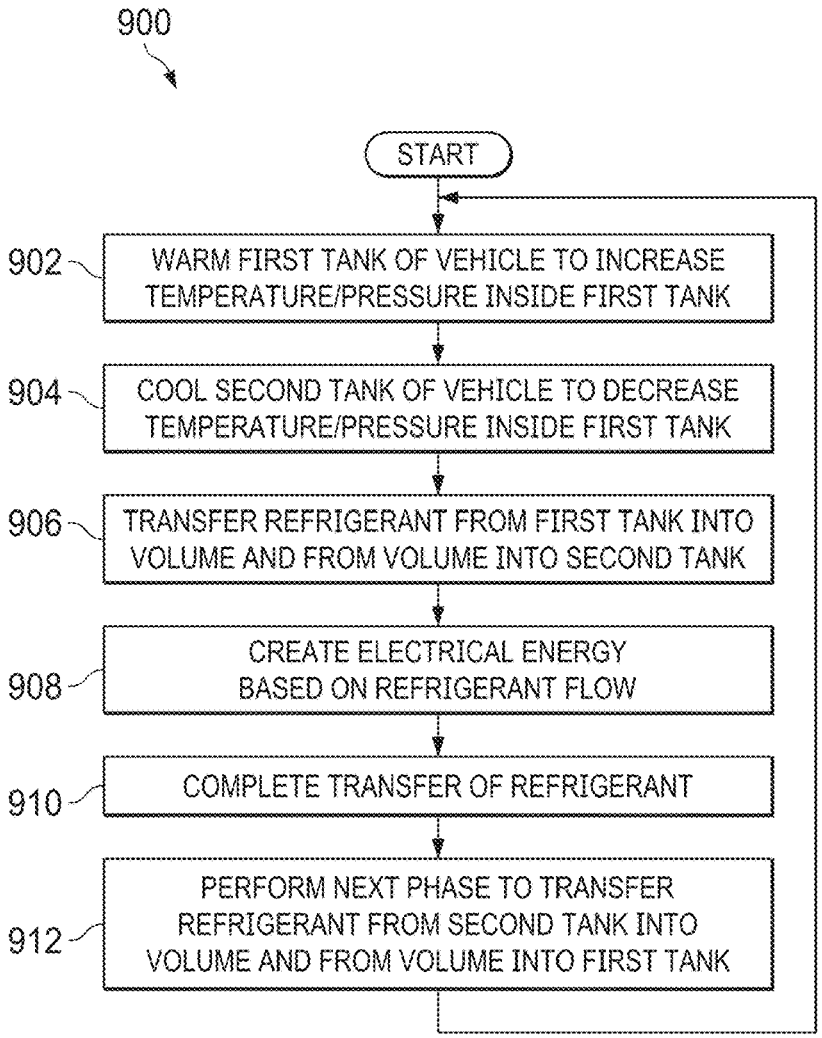
FIG. 9 illustrates an example method for free-piston power generation based on thermal differences in accordance with this disclosure.

FIG. 9 illustrates an example method 900 for free-piston power generation based on thermal differences in accordance with this disclosure. For ease of explanation, the method 900 is described as involving any of the underwater vehicles 100, 200, 300 using any of the power generation systems 400, 500, 600, 700, 800. However, the method 900 can be used with any suitable vehicle and with any suitable power generation system.

As shown in FIG. 9, a first tank of a vehicle is warmed at step 902, and a second tank of the vehicle is cooled at step 904. This can include, for example, heating the tank 402 using warmer water in the insulated water jacket 440 to increase the pressure within the tank 402. The warmer water can represent water that was captured at or near the surface of a body of water, water that was captured near a thermal vent, or water that was warmed using solar energy. This can also include cooling the tank 404 using colder water in the insulated water jacket 442 to decrease the pressure within the tank 404. The colder water can represent water that was captured below the surface of a body of water or water that was cooled through radiative or convective cooling.

Refrigerant is transferred from the first tank into a volume and from the volume into the second tank at step 906, and electrical energy is created based on the refrigerant flow at step 908. This can include, for example, refrigerant flowing out of the tank 402 into the volume 418 and refrigerant flowing out of the volume 418 into the tank 404, causing the piston 416 to move in a first direction. This can also include the piston 422 moving in the same first direction since it is connected to the piston 416. Depending on the implementation, this can further include movement of the piston 422 causing hydraulic fluid to pass through a generator 434, hydraulic fluid to be sprayed onto the generator 534, or one gear to move against another gear in the generator 834. Of course, the flow of refrigerant can be used to generate electrical energy in any other suitable manner.

Eventually, the transfer of refrigerant is completed at step 910, which ends this phase of a power generation cycle. Note that some refrigerant may remain in the first tank, and the amount can vary depending on the temperatures and pressures of the tanks. However, the amount of refrigerant transferred to and from the tanks is ideally adequate to generate enough electrical power for the vehicle. At this point, the next phase of the power generation cycle can occur to transfer the refrigerant from the second tank into the volume and from the volume into the first tank at step 912. This can include, for example, performing steps 902-910 again but with the temperatures/pressures of the tanks 402 and 404 reversed. This generates additional electrical energy that can be stored or used.

The amount of power generated using this approach can vary depending on the actual implementation of the power generation system. Based on laboratory analysis, specific implementations of the power generation systems can achieve a 100 to 200 Watt-hour (WHr) capacity and a total system energy yield of 35 to 135 kJ where a 15° C. temperature differential can be obtained. Where an 8° C. temperature differential can be obtained, specific implementations of the power generation systems can achieve a 25 to 50 WHr capacity. However, these values are for illustration only and relate to specific implementations and temperature differences.

Depending on the operations of the underwater vehicle and therefore the power required by the vehicle, the method 900 shown in FIG. 9 can occur at any suitable interval. For example, a glider (such as the vehicle 100) can be placed into a body of water and travel a short or long distance using an initial charge on the vehicle's power storage 316. This initial travel can occur over days, weeks, or even months. During this time, the glider may or may not require a recharge of its power supply. Once at or near a desired location, the glider can begin a process of monitoring a specified area, transmitting data, and performing other operations. During these periods, the glider can perform the charging process approximately once per month, although other intervals can be used depending on a number of factors (such as current or anticipated operations).

Although FIG. 9 illustrates one example of a method 900 for free-piston power generation based on thermal differences, various changes may be made to FIG. 9. For example, while FIG. 9 shows a series of steps, various steps in FIG. 9 can overlap, occur in parallel, occur in a different order, or occur any number of times. As particular examples, steps 906-908 can occur concurrently since it is the transfer of refrigerant that leads to the generation of electrical energy.

Figure 10:
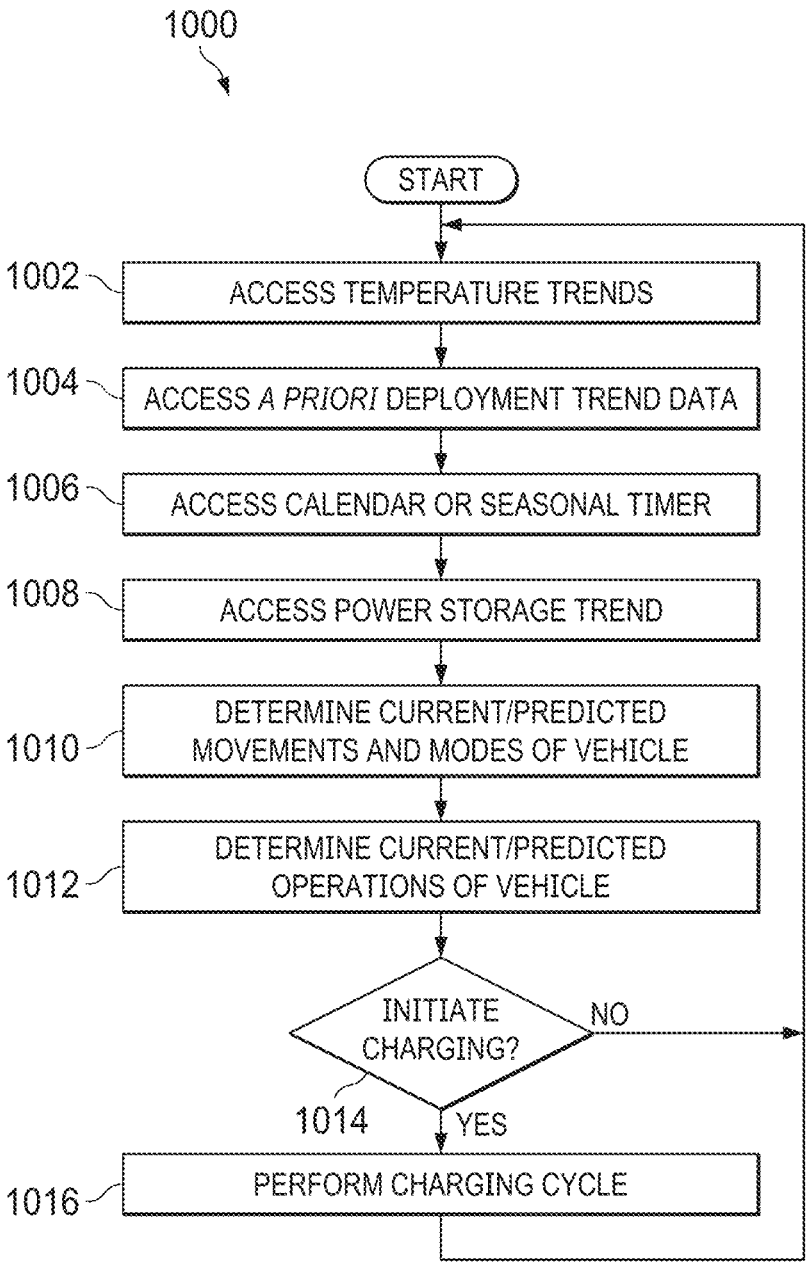
FIG. 10 illustrates an example method for controlling power charging cycles of an underwater vehicle in accordance with this disclosure.

FIG. 10 illustrates an example method 1000 for controlling power charging cycles of an underwater vehicle in accordance with this disclosure. For ease of explanation, the method 1000 is described as involving any of the underwater vehicles 100, 200, 300 using any of the power generation systems 400, 500, 600, 700, 800. However, the method 1000 can be used with any suitable vehicle and with any suitable power generation system.

As shown in FIG. 10, steps 1002-1008 are associated with an environmental and seasonal control segment in which the underwater vehicle obtains environmental and seasonal data to be used to make predictions about when to initiate a recharge of its power supply. For example, temperature trends are accessed or obtained at step 1002, and a priori deployment trend data is accessed or obtained at step 1004. This can include, for example, the controller 302 accessing data stored in the memory 304. The temperature trends can identify changes in water temperatures (possibly including both surface water and underwater temperatures) over time, possibly along with changes in air temperatures. These trends can be based on sensor measurements captured by the sensor components 306 over that time. The a priori deployment trend data can include data that was stored in the memory 304 prior to deployment or use of the underwater vehicle, such as predicted weather patterns or climate patterns over a course to be traveled or a location of use. As a particular example, the a priori deployment trend data can identify potential charging opportunities based on predicted weather patterns. A calendar or seasonal timer is accessed at step 1006. This can include, for example, the controller 302 accessing a current date to identify expected weather patterns or climate patterns for the given time of year at a given location. In addition, a power storage trend is accessed or obtained at step 1008. This can include, for example, the controller 302 accessing data stored in the memory 304. The power storage trend can identify how the amount of power stored in the power storage 316 has varied over time, which can possibly include measurements of power levels obtained during previous recharges of the power storage 316.

Steps 1010-1012 in FIG. 10 are associated with a mission and system control segment in which the underwater vehicle obtains data about its expected operations to be used to make predictions about when to initiate a recharge of its power supply. For example, current or predicted movements and modes of the underwater vehicle are determined at step 1010. This can include, for example, the controller 302 determining whether the underwater vehicle is performing or is expected to perform gliding operations to travel over short or long distances. This can also include the controller 302 determining whether the underwater vehicle is performing or is expected to perform buoy operations in which the underwater vehicle remains at or near a specified location or within a specified area. These different modes of operation can involve different movements of the underwater vehicle and therefore different power consumptions. Also, current or predicted operations of the vehicle are determined at step 1012. This can include, for example, the controller 302 determining whether the underwater vehicle is performing or is expected to perform dive operations, sensor collection, external communications, housekeeping functions, or other operations. The numbers and types of operations can require different power consumptions by the underwater vehicle.

Using this type of information, a decision can be made whether to initiate charging of the underwater vehicle at step 1014. This can include, for example, the controller 302 using the various data collected or obtained to identify a setpoint or limit for the charge on the power storage 316 of the underwater vehicle. The setpoint or limit can identify the point at which the power stored on the power storage 316 falls below a desired level and recharging is needed. By using various trend data, predicted weather/climate data, and other data, the setpoint or limit can be established so that the setpoint or limit is violated at a time when recharging may occur successfully. If charging of the underwater vehicle is initiated, a charging cycle can occur at step 1016. The charging cycle may be performed as shown in FIG. 9. Thus, FIG. 10 may generally represent an outer control loop that is used to control when the inner loop of FIG. 9 is performed.

As a particular example of how the method 1000 of FIG. 10 can be used, assume that an underwater vehicle first operates in glider mode (such as by traveling horizontally with its wings 106 extended) and then, when a desired location is reached, operates in buoy mode (such as by operating vertically with its wings 106 stowed). The vehicle can then use a priori information on expected seasonal conditions and measured temperature trends to judge how long it should wait until a recharge. This can take place at periodic times by using a clock or timer to know the day/night pattern based on its current location, which may allow the vehicle to only attempt recharges at certain times (such as only at night for concealment purposes). If power generation conditions are not favorable for a prolonged period of time, a bootstrap power pack may be used to attempt some pre-determined revival strategy. Pressure sensors can be used by the vehicle to estimate its depth and help ensure that the vehicle does not breach the surface of the water unless desired (such as during charging operations).

Although FIG. 10 illustrates one example of a method 1000 for controlling power charging cycles of an underwater vehicle, various changes may be made to FIG. 10. For example, while FIG. 10 shows a series of steps, various steps in FIG. 10 can overlap, occur in parallel, occur in a different order, or occur any number of times.

It should be noted that while various power generation systems and methods are described above as being used to power an underwater vehicle, the power generation systems and methods can be used in other ways. For example, the power generation systems and methods can be used to charge power carriers, such as those described in U.S. patent application Ser. No. 15/264,399 filed on Sep. 13, 2016 (which is hereby incorporated by reference in its entirety). The power carriers can then be used in any suitable manner, such as to power underwater vehicles or provide electricity to other devices or systems. With an adequate number of power generation systems (and optionally an adequate number of power carriers), a large amount of power can be made available for use. Also, as noted above, other approaches can be used to create an adequate temperature or pressure differential. As a particular example, the approaches described in U.S. Patent Application No. 62/414,216 filed on Oct. 28, 2016, U.S. Patent Application No. 62/414,567 filed on Oct. 28, 2016, U.S. patent application Ser. No. 15/725,538 filed on Oct. 5, 2017, and U.S. patent application Ser. No. 15/787,948 filed on Oct. 19, 2017 (all of which are hereby incorporated by reference in their entirety) for using solar energy to heat a tank and/or using radiative or convective cooling to cool a tank can be used here.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the scope of this disclosure, as defined by the following claims.

What is claimed is:

1. An apparatus comprising:

a generator configured to generate electrical power;

first and second tanks each configured to receive and store a refrigerant under pressure;

a first piston assembly having a first piston that divides a volume within the first piston assembly into first and second spaces each configured to receive the refrigerant from at least one of the tanks;

a second piston assembly having a second piston coupled to the first piston; and a linear gear extending between the first piston assembly and the second piston assembly, a circular gear attached to and movable with at least one f the pistons and configured to move along the linear gear, and a gearbox configured to translate a rotational speed of the circular gear into a higher rotational speed for the generator;

wherein the generator is configured to generate the electrical power based on the higher rotational speed produced by the gearbox.

2. The apparatus of claim 1, further comprising:

at least one first valve fluidly coupling the first tank and at least one of the first and second spaces; and at least one second valve fluidly coupling the second tank and at least one of the first and second spaces.

3. The apparatus of claim 1, further comprising:

first and second insulated water jackets each configured to receive and retain water, the first tank located within the first insulated water jacket, the second tank located within the second insulated water jacket.

4. The apparatus of claim 1, wherein:

the second piston is configured to pull a fluid into a volume within the second piston assembly and push the fluid out of the volume within the second piston assembly; and the apparatus further comprises an orifice configured to slow movement of the fluid and reduce a loading placed on the gearbox.

5. An apparatus comprising:

a generator configured to generate electrical power;

first and second tanks each configured to receive and store a refrigerant under pressure;

a first piston assembly having a first piston that divides a volume within the first piston assembly into first and second spaces each configured to receive the refrigerant from at least one of the tanks; and a second piston assembly having a second piston coupled to the first piston:

wherein the second piston is configured to pull a fluid into a volume within the second piston assembly and push the fluid out of the volume within the second piston assembly; and wherein the generator is configured to generate the electrical power based on movement of the fluid.

6. The apparatus of claim 5, further comprising:

at least one valve configured to control the flow of the fluid through the generator.

7. The apparatus of claim 5, further comprising:

a reservoir configured to hold the fluid;

wherein the second piston is configured to pull the fluid from the reservoir and push the fluid into the reservoir.

8. The apparatus of claim 7, wherein the generator is positioned within the reservoir.

9. The apparatus of claim 5, wherein:

the second piston divides the volume within the second piston assembly into multiple spaces each configured to receive the fluid; and the second piston is configured to pull the fluid into one of the multiple spaces and push the fluid out of another of the multiple spaces during movement of the second piston.

10. A system comprising:

a vehicle comprising a body;

the vehicle also comprising a power generator, the power generator comprising:

a generator configured to generate electrical power;

first and second tanks each configured to receive and store a refrigerant under pressure;

a first piston assembly having a first piston that divides a volume within the first piston assembly into first and second spaces each configured to receive the refrigerant from at least one of the tanks;

a second piston assembly having a second piston coupled to the first piston; and a linear gear extending between the first piston assembly and the second piston assembly, a circular gear attached to and movable with at least one of the pistons and configured to move along the linear gear, and a gearbox configured to translate a rotational speed of the circular gear into a higher rotational speed for the generator;

wherein the generator is configured to generate the electrical power based on the higher rotational speed produced by the gearbox.

11. The system of claim 10, wherein the power generator further comprises:

at least one first valve fluidly coupling the first tank and at least one of the first and second spaces; and at least one second valve fluidly coupling the second tank and at least one of the first and second spaces.

12. The system of claim 10, wherein the power generator further comprises:

first and second insulated water jackets each configured to receive and retain water, the first tank located within the first insulated water jacket, the second tank located within the second insulated water jacket.

13. The system of claim 10, wherein:

the second piston is configured to pull a fluid into a volume within the second piston assembly and push the fluid out of the volume within the second piston assembly; and the power generator further comprises an orifice configured to slow movement of the fluid and reduce a loading placed on the gearbox.

14. A system comprising:

a vehicle comprising a body;

the vehicle also comprising a power generator, the power generator comprising;

a generator configured to generate electrical power;

first and second tanks each configured to receive and store a refrigerant under pressure;

a first piston assembly having a first piston that divides a volume within the first piston assembly into first and second spaces each configured to receive the refrigerant from at least one of the tanks; and a second piston assembly having a second piston coupled to the first piston:

wherein the second piston is configured to pull a fluid into a volume within the second piston assembly and push the fluid out of the volume within the second piston assembly; and wherein the generator is configured to generate the electrical power based on movement of the fluid.

15. The system of claim 14, further comprising:

a reservoir configured to hold the fluid;

wherein the second piston is configured to pull the fluid from the reservoir and push the fluid into the reservoir.

16. The system of claim 14, wherein:

the second piston divides the volume within the second piston assembly into multiple spaces each configured to receive the fluid; and the second piston is configured to pull the fluid into one of the multiple spaces and push the fluid out of another of the multiple spaces during movement of the second piston.

17. A method comprising:

storing a refrigerant under pressure in first and second tanks;

moving a first piston in a first piston assembly based on flows of the refrigerant to and from the tanks, the first piston dividing a volume within the first piston assembly into first and second spaces each configured to receive the refrigerant from at least one of the tanks;

moving a second piston of a second piston assembly, the second piston coupled to the first piston;

moving a circular gear along a linear gear extending between the first piston assembly and the second piston assembly, the circular attached to and gear attached to and movable with at least one of the pistons;

translating a rotational speed of the circular gear into a higher rotational speed; and generating electrical power based on the higher rotational speed.

18. The method of claim 17, further comprising:

warming one of the tanks and cooling another of the tanks to create a pressure differential between the tanks; and creating the flows of the refrigerant from the first tank to the first space and from the second space to the second tank based on the pressure differential.

19. A method comprising:

storing a refrigerant under pressure in first and second tanks;

moving a first piston in a first piston assembly based on flows of the refrigerant to and from the tanks, the first piston dividing a volume within the first piston assembly into first and second spaces each configured to receive the refrigerant from at least one of the tanks;

moving a second piston of a second piston assembly, the second piston coupled to the first piston;

creating a flow of fluid onto or through a generator using the second piston assembly; and generating electrical power using the generator.

20. A method comprising:

storing a refrigerant under pressure in first and second tanks;

warming the first tank and cooling the second tank to create a pressure differential between the tanks;

moving a first piston in a first piston assembly based on flows of the refrigerant from the first tank to a first space and from a second space to the second tank, the first piston dividing a volume within the first piston assembly into the first and second spaces each configured to receive the refrigerant from at least one of the tanks, the flows of the refrigerant created based on the pressure differential;

moving a second piston of a second piston assembly, the second piston coupled to the first piston;

generating electrical power based on movement of at least one of the first and second pistons; and reversing the warming and cooling of the tanks in order to reverse the movement of the first and second pistons.

* * * * *